US005359578A

United States Patent [19]

Truini

[11] Patent Number: 5,359,578

[45] Date of Patent: Oct. 25, 1994

[54] TIMEPIECE FOR GEOMETRICALLY SYNCHRONIZED TIME INDICATIONS

[76] Inventor: Stefano Truini, 285 Central Park West, New York, N.Y. 10024

[21] Appl. No.: 891,950

[22] Filed: Jun. 1, 1992

[51] Int. Cl.[5] ..... G04B 19/00; G04B 19/20; G04B 19/06

[52] U.S. Cl. ..... 368/76; 368/77; 368/223; 368/233

[58] Field of Search ..... 368/76, 77, 80, 223, 368/228, 232–234

[56] References Cited

U.S. PATENT DOCUMENTS 2,051,611 8/1936 Liner .
2,202,581 5/1940 Hammer .
4,438,682 1/1984 Winter .
4,659,232 4/1987 Coster et al. .
4,712,924 12/1987 Agostini .
5,051,968 9/1991 Calabrese .
5,103,434 4/1992 Sullivan .
5,134,595 7/1992 Faber .

*Primary Examiner*—Vit W. Miska

[57] ABSTRACT

A clock display mechanism including circular discs or rings which rotate within a fixed circular plane or ring to indicate minutes and hours by providing that one rotating indicator disc or ring acts as a geometrical link between the indication of minutes and the indication of hours.

8 Claims, 12 Drawing Sheets

TIMEPIECE FOR GEOMETRICALLY SYNCHRONIZED TIME INDICATIONS

BACKGROUND OF THE INVENTION

1. Field of the Invention

This invention relates to clock mechanisms and in particular to clock mechanisms which use rotating discs or rings as the means for time indication.

2. Description of the Background Art

At present there is wide usage of colors, interestingly shaped indicators and dials, and to a lesser extent, interesting relationships between all three, for the display of time in one fashion or another. Several previous inventions, namely Patents GB 1370114, PCT WO 88/02507, EP 0 425430 A1, U.S. Pat. No. 4,833,661, and CH 679260 G A3, have arrived at inventive and unique methods for the display of time but in every case there is a fundamental relationship between each time indicator and the dial such that the geometrical positioning of both time indicators relative to the dial remains consistent with traditional usage, i.e., 360° of the dial is a continual repetition of 60 minutes, 12 hours, or 24 hours. In some of the embodiments of Patent CH 679260 G A3 there is non-traditional usage for the display of minutes, however these embodiments have a reasonable accuracy no greater than to within the nearest 10 minutes. In Patent EP 0 425430 A1 there is non-traditional usage for the display of minutes, however the display is stationary and therefore repetitious. In U.S. Pat. No. 4,833,661 there is non-traditional usage for the display of hours, however this is for point of interest and not for point of improved function.

SUMMARY OF THE INVENTION

The current invention comprehends an improved clock display mechanism wherein a greater aesthetic and realistic effect is achieved in the determination of time by providing that a geometrical link is used as a synchronizing element between the indication of minutes and the indication of hours, such that time in a 12 hour system is seen from one individual point instead of from one individual point and one repetitious point. It is believed that time as presented in this form is more representative of the actual individual passage of time.

DESCRIPTION OF THE FIGURES

Figure 1A:
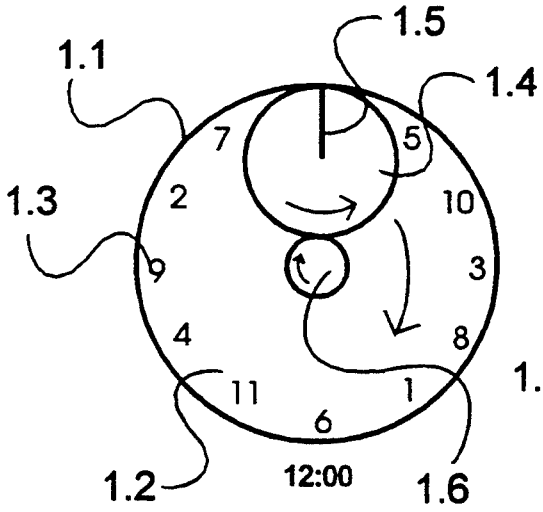
FIGS. 1*a*–1*d* contain frontal, cross sectional, geared and motive views of the first embodiment of the invention.

The device illustrated by FIG. 1 is composed of:

(1.1) a fixed outer ring with a circumference of 12*n;*

(1.2) a fixed base plate with a circumference of 12*n;*

(1.3) numerical or other indicia;

(1.4) an eccentric, geared circular disc or satellite disc with a circumference of 5*n;*

(1.5) an indicator line;

(1.6) a concentric, geared circular disc or central disc with a circumference of 2*n;*

(1.7) a geared outer ring with a circumference of 12*n;*

(1.8) a central drive pin;

The device functions as the drive mechanism (not illustrated) revolves the central drive pin 1.8 35 rotations in 12 hours. Central drive pin 1.8 is affixed to central disc 1.6 which then also revolves 30 times in 12 hours. Central disc 1.6 is positioned to mesh its gears with the gears of satellite disc 1.4, and satellite disc 1.4 is positioned to mesh its gears with the gears of both central disc 1.6 (as already mentioned) and the geared outer ring 1.7, as illustrated in FIG. 1*d*, such that, as central disc 1.6 revolves 30 time in 12 hours it revolves satellite disc 1.4 about the geared outer ring 1.7 5 times in 12 hours, and upon the geared outer ring 1.7 12 times in twelve hours.

The dimensions of each geared piece, i.e., (1.4)=5*n*, (1.6)=2*n*, (1.7)=12*n*, are such that after 35/12 rotations of central disc 1.6, satellite disc 1.4 has made one full rotation upon the circumference of the geared outer ring 1.7. As satellite disc 1.4 begins to revolve about the geared outer ring 1.7 in a clockwise direction the indicator line 1.5, which is upon satellite disc 1.4, begins to move in a counter clockwise direction (as illustrated by the directional arrows in FIG. 1*a*.), such that by measuring the distance between the point where satellite disc 1.4 and the geared outer ring 1.7 make contact, and the point of the indicator line 1.5 which is upon the circumference of satellite disc 1.4, it is possible to determine what portion of a full rotation satellite disc 1.4 has made upon the geared outer ring 1.7, and in that one full rotation of satellite disc 1.4 upon the geared outer ring 1.7 is equal to one hour it is then possible to determine what portion of an hour, i.e., how many minutes, has past since the indicator line 1.5 was last in contact with the geared outer ring 1.7.

Figure 1B:
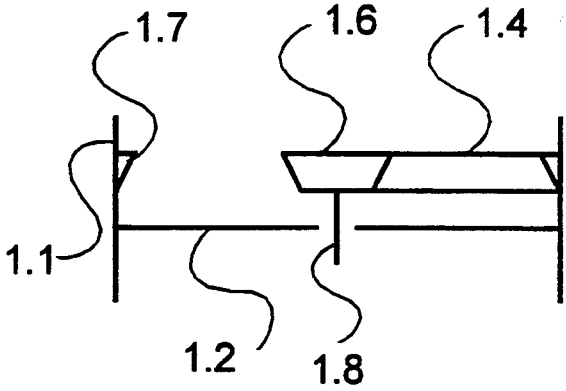
Figure 1C:
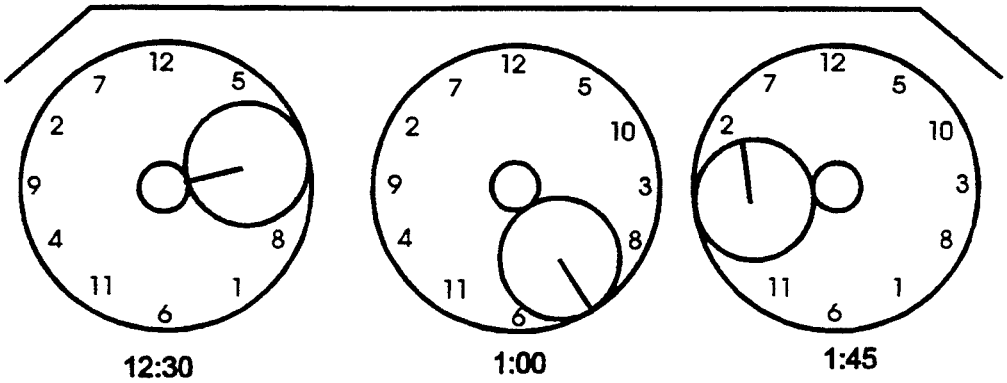
Figure 1D:
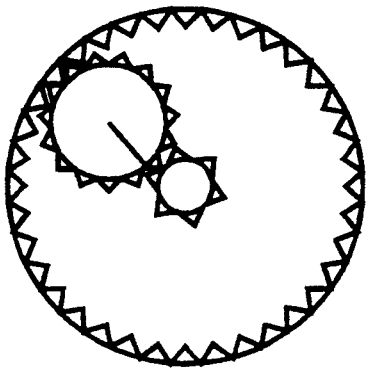

If the indicator line 1.5 is pointing straight upward, as illustrated in FIG. 1*a*, then the time is 12:00. After one full rotation of satellite disc 1.4 upon the geared outer ring 1.7 from the 12:00 position the indicator line 1.5 is pointing toward the outer ring 1.1 exactly where the 5:00 position on a normal two hands clock would be, however on this clock it is the 1:00 position, as illustrated in FIG. 1*c*. If satellite disc 1.4 continues to revolve about the geared outer ring 1.7 from the 1:00 position its next full rotation, and therefore hour, will end up exactly where the 10:00 position on a normal two hands clock would be except that on this clock it is the 2:00 position. As satellite disk 1.4 continues rotating in this fashion it begins to follow the pattern of a twelve sided star wherein each point of the star corresponds to one of the twelve hours of the clock and wherein the circumferential distance between each consecutive hour as being represented by points of the star upon the geared outer ring 1.7 is equal to 5*n*.

To determine the hour, it is first necessary to determine how many minutes have elapsed as indicated by the rotation satellite disc 1.4 upon the geared outer ring 1.7, and then to count either backward this number of minutes or forward the remaining number of minutes using the indicia 1.3 labeled upon the fixed base plate 1.2. Between each indicia there are 12 minutes, and therefore between 5 indicia there is one hour. As measured upon the fixed outer ring 1.1 one hour, or 60 minutes, is equal to 150° of the 360° circumference at any given moment, and because each hour is positioned differently upon the fixed outer ring 1.1, there is never a repetition of the position of each hour upon the fixed outer ring 1.1 from one hour to the next, although the entire process repeats itself every twelve hours.

Because satellite disc 1.4 is free floating, it is necessary to hold it in its position between central disc 1.6 and the geared outer ring 1.7 by first inclining its rim such that its base circumference is greater than its top circumference, to then incline the rim of central disc 1.6 in just the opposite fashion, such that its base circumference is smaller than its top circumference, and to then incline the geared outer ring 1.7 so that it has a greater base circumference than its top circumference. In this manner satellite disc 1.4 is held firmly flat while allowing it to do its rotation, as illustrated in FIG. 1*b*.

The device illustrated by FIG. 2 is composed of:

(2.1) a fixed outer ring with a circumference of 12*n*;
(2.2) a fixed base plate with a circumference of 12*n*;
(2.3) numerical or other indicia;
(2.4) an eccentric geared circular disc with a circumference of 10*n*;
(2.5) a 180° section of eccentric disc 2.4 which represents 06 minutes for the odd hours;
(2.6) a 180° section of eccentric disc 2.4 which represents 06 minutes for the even hours;
(2.7) a double ended hours indicator wherein end 2.7*a* indicates even hours and end 2.7*b* indicates odd hours, and which devides eccentric disc 2.4 into its two halves 2.5 and 2.6;
(2.8) a minutes indicator hand;
(2.9) an eccentric drive pin
(2.10) a connecting piece between the eccentric drive pin 2.9 and the central drive pin 2.11 measuring 1*n*;
(2.11) a central drive pin;
(2.12) a fixed, geared outer ring with a circumference of 12*n*.

The device functions as the drive mechanism (not illustrated) revolves the central drive pin 2.11 5 rotations in 12 hours. The central drive pin 2.11 is affixed to the eccentric drive pin 2.9 by a connecting piece 2.10, and the eccentric drive pin 2.9 then also revolves 5 times in 12 hours. The eccentric drive pin 2.9 runs up through the center of eccentric disc 2.4 forcing eccentric disc 2.4 to mesh its gears with the gears of the geared outer ring 2.12, as illustrated in FIG. 2*d*, and revolve in eccentric fashion 5 times in 12 hours about the circumference of the geared outer ring 2.12. The top of the eccentric drive pin 2.9 is affixed to a minutes indicator 2.8, which like the eccentric drive pin 2.9 revolves 5 times in 12 hours.

The dimensions of each geared piece, i.e., (2.4)=10*n*, (2.12)=12*n*, are such that after 5/12 rotations of the central drive pin 2.11, and therefore also the eccentric drive pin 2.9 and the minutes indicator 2.8, eccentric disc 2.4 makes ½ rotation upon the geared outer ring 2.12. As eccentric disc 2.4 begins to revolve about the geared outer ring 2.12 in a clockwise direction with the minutes indicator 2.8 the hours indicator 2.7 begins to move in a counter clockwise direction (as illustrated by the directional arrows in FIG. 2*a*.), such that by measuring the distance between the minutes indicator 2.8, or the point where eccentric disc 2.4 and the geared outer ring 2.12 make contact, and the point of the hours indicator 2.7 which last made contact with the geared outer ring 2.12, it is possible to determine what portion of a rotation one of the 180′ sections, i.e., 2.5 or 2.6, of eccentric disc 2.4 has made upon the geared outer ring 2.12, and in that a 180′ rotation of eccentric disc 2.4 upon the geared outer ring 2.12 is equal to one hour it is then possible to determine what portion of an hour, i.e., how many minutes, has past since the hours indicator 2.7 was last in contact with the geared outer ring 2.12.

Figure 2A:
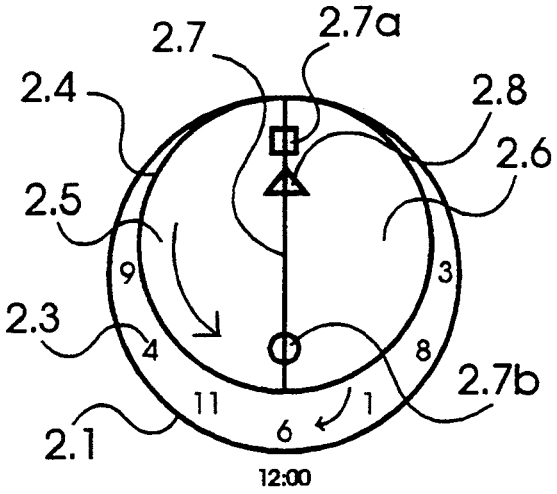
FIGS. 2*a*–2*d* contain frontal, cross sectional, geared and motive views of the second embodiment of the invention.
Figure 2B:
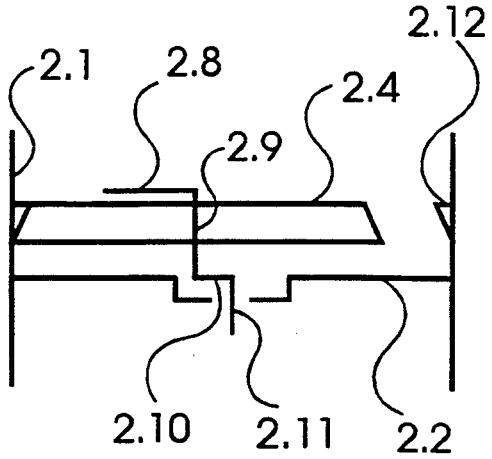
Figure 2C:
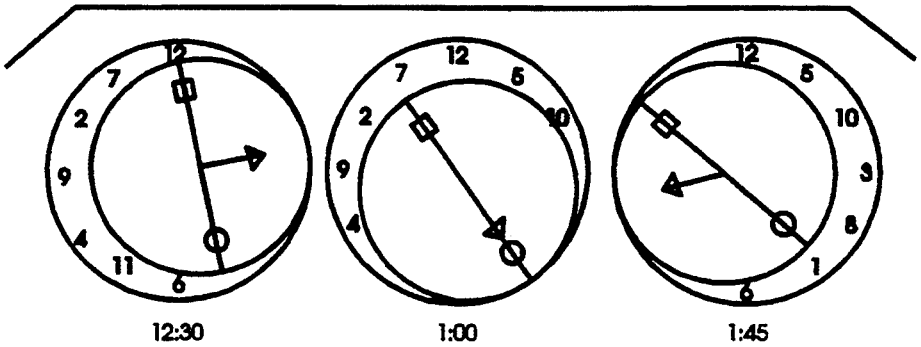
Figure 2D:
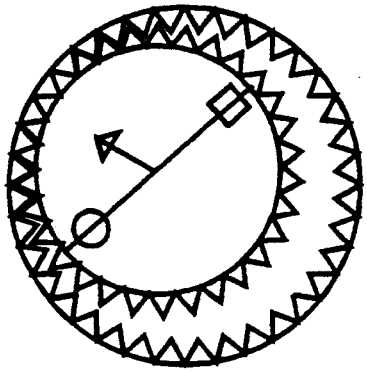

If the minutes indicator 2.8 and the even's end of the hours indicator 2.7*a* are both pointing straight upward, as illustrated in FIG. 2*a*., then the time is 12:00. After a 180° rotation of eccentric disc 2.4 upon the geared outer ring 2.12 from the 12:00 position the minutes indicator 2.8 and the odd's end of the hours indicator 2.7*b* are both pointing toward the outer ring 2.1 exactly where the 5:00 position on a normal two hands clock would be, however on this clock it is the 1:00 position as illustrated in FIG. 2*c*. If eccentric disc 2.4 continues to revolve about the geared outer ring 2.12 from the 1:00 position its next 180° rotation upon the geared outer ring 2.12, and therefore hour, will end up exactly where the 10:00 position on a normal two hands clock would be except that on this clock it is the 2:00 position. As eccentric disc 2.4 continues rotating in this fashion it begins to follow the pattern of a twelve sided star wherein each point of the star corresponds to one of the twelve hours of the clock and wherein the circumferential distance between each consecutive hour as being represented bypoints of the star upon the geared outer ring 2.12 is equal to 5*n*.

To determine the hour it is first necessary to determine how many minutes have elapsed as indicated by the position of the minutes indicator 2.8 on either of the 180° sections 2.5 and 2.6, and then to count either backward this number of minutes or forward the remaining number of minutes using the indicia 2.3 labeled upon the fixed base plate 2.2. Between each indicia there are 12 minutes, and therefore between 5 indicia there is one hour. As measured upon the fixed outer ring 2.1, one hour, or 60 minutes, is equal to 150° of the 360° circumference at any given moment, and because each hour is positioned differently upon the fixed outer ring 2.1, there is never a repetition of the position of each hour upon the fixed outer ring 2.1 from one hour to the next, although the entire process repeats itself every twelve hours.

Because the relationship between the eccentric drive pin 2.9, eccentric disc 2.4 and the geared outer ring 2.12 may not be a completely level one it is necessary to first incline the rim of eccentric disc 2.4 such that its base circumference is greater than its top circumference and to then incline the rim of the geared outer ring 2.12 such that its base circumference is also greater than its top circumference. In this manner eccentric disc 2.4 is held firmly flat by both the eccentric drive pin 2.9 and the geared outer ring 2.12 while it is allowed to make its rotations, as illustrated in FIG. 2*b*.

The device illustrated by FIG. 3 is composed of:

(3.1) a fixed outer ring with a circumference of 12*n;*
(3.2) a fixed base plate with a circumference of 12*n;*
(3.3) numerical or other indicia;
(3.4) an eccentric, geared circular disc with a circumference of 7*n;*
(3.5) an indicator line;
(3.6) a fixed, geared outer ring with a circumference of 12*n;*
(3.7) an eccentric drive pin;
(3.8) a connecting piece between the eccentric drive pin 3.7 and the central drive pin 3.9 measuring 2.5*n;*
(3.9) a central drive pin.

The device functions as the drive mechanism (not illustrated) revolves the central drive pin 3.9 7 rotations in 12 hours. The central drive pin 3.9 is affixed to the eccentric drive pin 3.7 by a connecting piece 3.8, and the eccentric drive pin 3.7 then also revolves 7 times in 12 hours. The eccentric drive pin 3.7 runs up through the center of eccentric disc 3.4 forcing eccentric disc 3.4 to mesh its gears with the gears of the geared outer ring 3.6, as illustrated in FIG. 3*d*., and revolve in eccentric fashion 7 times in 12 hours about the circumference of the geared outer ring 3.6.

The dimensions of each geared piece, i.e., (3.4)=7*n*, (3.6)=12*n*, are such that after 7/12 rotations of the central drive pin 3.9, and therefore the eccentric drive pin 3.7, the eccentric disc 3.4 makes one full rotation upon the geared outer ring 3.6. As eccentric disc 3.4 begins to revolve about the geared outer ring 3.6 in a clockwise direction, the indicator line 3.5, which is upon eccentric disc 3.4, begins to move in a counter clockwise direction, as illustrated by the directional arrows in FIG. 3*a*., such that by measuring the distance between the point where eccentric disc 3.4 and the geared outer ring 3.6 make contact, and the point of the indicator line 3.5 which is upon the circumference of eccentric disc 3.4, it is possible to determine what portion of a full rotation eccentric disc 3.4 has made upon the geared outer ring 3.6, and in that one full rotation of eccentric disc 3.4 upon the geared outer ring 3.6 is equal to one hour it is then possible to determine what portion of an hour, i.e., how many minutes, has past since the indicator line 3.5 was last in contact with the geared outer ring 3.6.

Figure 3A:
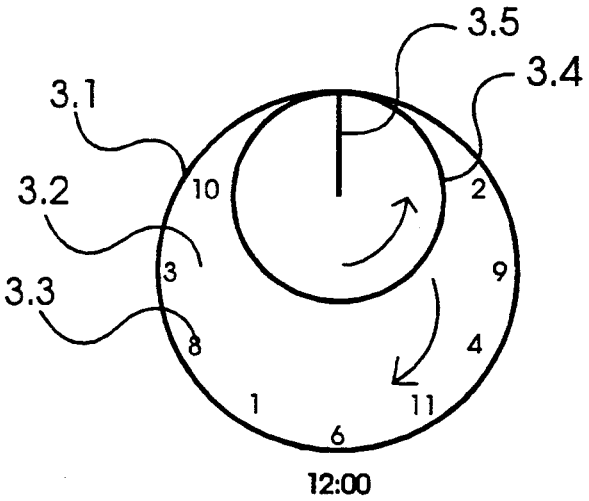
FIGS. 3*a*–3*d* contain frontal, cross sectional, geared and motive views of the third embodiment of the invention.

If the indicator line 3.5 is pointing straight upward, as illustrated in FIG. 3*a*., then the time is 12:00. After one full rotation of eccentric disc 3.4 upon the geared outer ring 3.6 from the 12:00 position the indicator line 3.5 is pointing toward the outer ring 3.1 exactly where the 7:00 position of a normal two hands clock would be, however on this clock it is the 1:00 position, as illustrated in FIG. 1*c*. If eccentric disc 3.4 continues to revolve about the geared outer ring 3.6 from the 1:00 position its next full rotation upon the geared outer ring 3.6 will end up exactly where the 2:00 position of a normal two hands clock would be, and with this clock it is also the 2:00 position. As eccentric disk 3.4 continues rotating in this fashion it begins to follow the pattern of a twelve sided star wherein each point of the star corresponds to one of the twelve hours of the clock and wherein the circumferential distance between each consecutive hour as being represented by points of the star upon the geared outer ring 3.6 is equal to 7*n*.

To determine the hour it is first necessary to determine how many minutes have elapsed as indicated by the position of the indicator line 3.5, and then to count either backward this number of minutes or forward the remaining number of minutes using the indicia 3.3 labeled upon the fixed base plate 3.2. Between each indicia there are 8.57 or 60/7 minutes and therefore between 7 indicia there is one hour. As measured upon the fixed outer ring 3.1, one hour, or 60 minutes, is equal to 210° of the 360° circumference at any given moment, and because each hour is positioned differently upon the fixed outer ring 3.1, there is never a repetition of the position of each hour upon the fixed outer ring 3.1 from one hour to the next, although the entire process repeats itself every twelve hours.

Figure 3B:
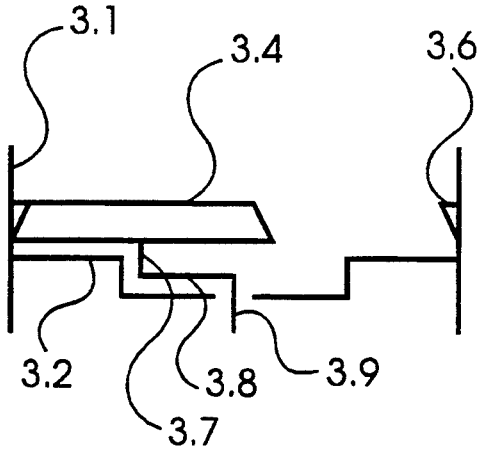
Figure 3C:
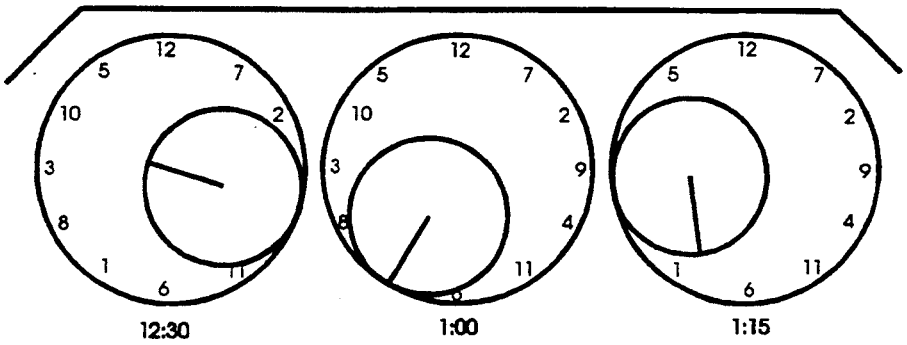
Figure 3D:
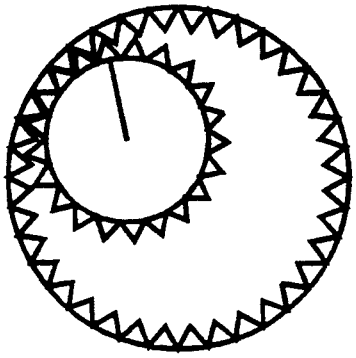

Because the relationship between the eccentric drive pin 3.9, eccentric disc 3.4 and the geared outer ring 3.6 may not be a completely stable one it is necessary to first incline the rim of eccentric disc 3.4 such that its base circumference is greater than its top circumference and to then incline the rim of the geared outer ring 3.6 such that its base circumference is also greater than its top circumference. In this manner eccentric disc 3.4 is held firmly flat by both the eccentric drive pin 3.7 and the geared outer ring 3.6 while it is allowed to make its rotations, as illustrated in FIG. 3*b*.

The device in FIG. 4 is composed of:

(4.1) a fixed outer ring with a circumference of 12*n;*
(4.2) a fixed base plate with a circumference of 12*n;*
(4.3) numerical or other indicia;
(4.4) an eccentric, geared circular disc or satellite disc with a circumference of 2.5*n;*
(4.5) an indicator dot upon the satellite disc 4.4;
(4.6) a concentric, geared circular disc or central disc with a circumference of 7*n;*
(4.7) an indicator line;
(4.8) a geared outer ring with a circumference of 12*n;*
(4.9) a central drive pin.

The device functions as the drive mechanism (not illustrated) revolves the central drive pin 4.9 19 times in 12 hours. The central drive pin 4.9 is affixed to central disc 4.6 which then also revolves 19 times in 12 hours. Central disc 4.6 is positioned to mesh its gears with the gears of satellite disc 4.4, and satellite disc 4.4 is positioned to mesh its gears with the gears of both central disc 4.6 (as already mentioned) and the geared outer ring 4.8, as illustrated in FIG. 4*d*, such that as central disc 4.6 revolves 19 times in 12 hours it revolves satellite disc 4.4 about the geared outer ring 7 times in 12 hours.

The dimensions of each geared piece, i.e., (4.4)=2.5*n*, (4.6)=7*n*, (4.8)=12*n*, are such that after 19/12 rotations of central disc 4.6, satellite disc 4.4 has revolved about the geared outer ring 4.8 7/12 of the circumference of the geared outer ring 4.8. As central disc 4.6 begins to rotate with its indicator line 4.7 in the clockwise direction satellite disc 4.4 begins to revolve about the geared outer ring 4.8 also in a clockwise direction, although its revolutions upon the geared outer ring 4.8 are in a counter clockwise direction, as illustrated by the directional arrows in FIG. 4*a*. By measuring the distance between the point where satellite disc 4.4 and central disc 4.6 make contact, and the point of the indicator line 4.7 which is upon the circumference of central disc 4.6 it is possible to determine what portion of a full rotation central disc 4.6 has made with respect to satellite disc 4.4, and in that one full rotation of central disc 4.6 with respect to satellite disc 4.4 is equal to one hour it is possible to determine what portion of an hour, i.e., how many minutes, has past since the indicator line 4.7 was last in contact with satellite disc 4.4.

Figure 4A:
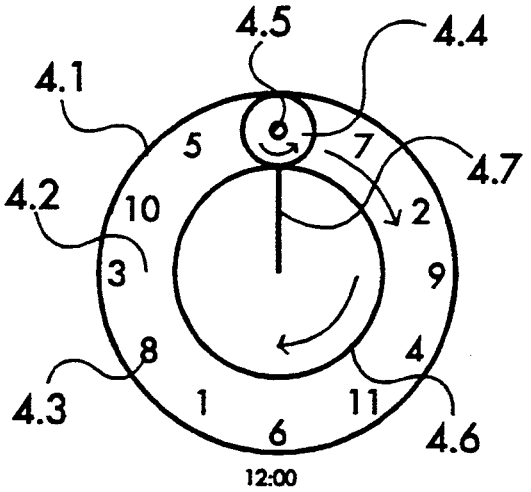
FIGS. 4*a*–4*d* contain frontal, cross sectional, geared and motive views of the fourth embodiment of the invention.
Figure 4B:
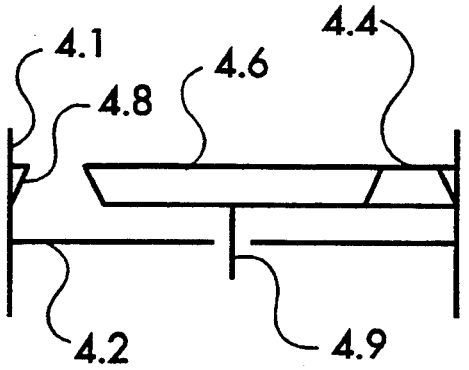
Figure 4C:
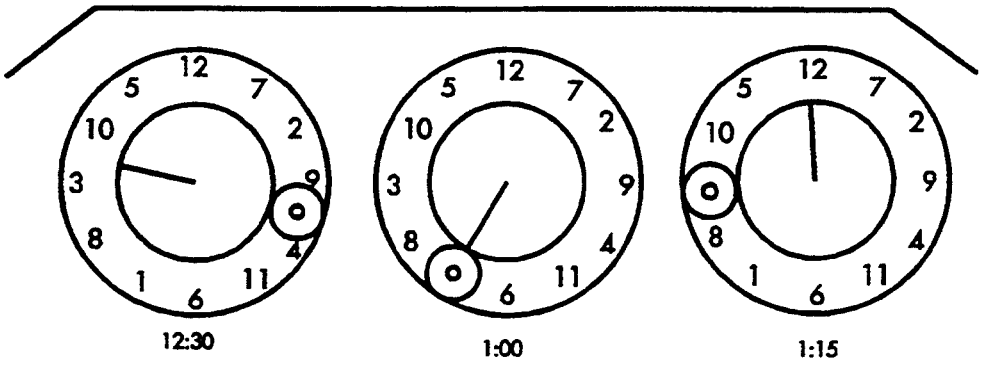
Figure 4D:
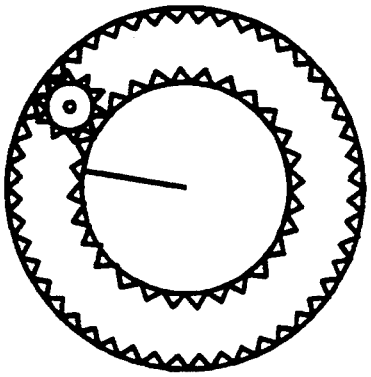

If the indicator line 4.7 is pointing straight upward and satellite disc 4.4 with its indicator dot 4.5 is positioned directly above the indicator line 4.7, and therefore in the upper most part of the fixed outer ring 4.8, then the time is 12:00, as illustrated in FIG. 4*a*. After 19/12 rotations of central disc 4.6 satellite disc 4.4 has revolved about the geared outer ring 4.8 7/12 of the circumference of the geared outer ring 4.8 and, along with the indicator line 4.7, is exactly where the 7:00 position on a normal two hands clock would be, however on this clock it is the 1:00 position, as illustrated in FIG. 4*c*. If central disc 4.6 continues to make another 19/12 rotation, and therefore another full rotation with respect to satellite disc 4.4, then satellite disc 4.4 will revolve another 7/12 of the circumference of the geared outer ring 4.8 and both the indicator line 4.7 and satellite disc 4.4 will be in the 2:00 position of a normal two hands clock, and with this clock it is also the 2:00 position. As satellite disk 4.4 continues rotating in this fashion it begins to follow the pattern of a twelve sided star wherein each point of the star corresponds to one of the twelve hours of the clock and wherein the circumferential distance between each consecutive hour as being represented by points of the star upon the geared outer ring 4.8 is equal to $7n$.

To determine the hour, it is first necessary to determine how many minutes have elapsed, as indicated by the position of the indicator line 4.7 with respect to satellite disc 4.4, and then to count either backward this number of minutes or forward the remaining number of minutes from the position of satellite disc 4.4 upon the geared outer ring 4.8 using the indicia 4.3. Between each indicia there are 8.57 or 60/7 minutes, and therefore between 7 indicia there is one hour. As measured upon the fixed outer ring 4.1, one hour or sixty minutes, is equal to 210° of the 360° circumference at any given moment, and because each hour is positioned differently upon the fixed outer ring 4.1, there is never a repetition of the position of each hourly sequence upon the fixed outer ring from one hour to the next, although the entire process repeats itself every twelve hours.

Because satellite disc 4.4 is free floating, it is necessary to hold it in its position between central disc 4.7 and the geared outer ring 4.8 by first inclining its rim such that its base circumference is greater than its top circumference, by then inclining the rim of central disc 4.7 in just the opposite fashion, such that its base circumference is smaller than its top circumference, and by then inclining the rim of the geared outer ring 4.8 so that its base circumference is greater than its top circumference. In this manner satellite disc 4.4 is held firmly flat while it is allowed to make its rotations, as illustrated in FIG. 4*b*.

The device in FIG. 5 is composed of:

(5.1) a fixed outer ring with a circumference of $12n$;

(5.2) a fixed base plate with a circumference of $12n$;

(5.3) an equilateral triangle with the points of its angles upon the circumference of the fixed outer ring 5.1, and with one point in the upper most point of this circumference;

(5.4) an eccentric, geared circular disc or satellite disc with a circumference of $4n$;

(5.5) an eccentric, geared circular disc or satellite disc with a circumference of $24/7n$ affixed concentrically to the underneath side of satellite disc 5.4;

(5.6) a minutes indicator line upon satellite disc 5.4;

(5.7) a concentric, geared circular disc or central disc with a circumference of $32/7n$;

(5.8) a concentric circular disc or central disc with a circumference less than $4n$ affixed concentrically to the upper side of central disc 5.7. Other than carrying the hours indicator line 5.9 this disc is mechanically cosmetic;

(5.9) an hours indicator line upon central disc 5.8;

(5.10) a fixed geared outer ring;

(5.11) a central drive pin.

The device functions as the drive mechanism (not illustrated) revolves the central drive pin 5.11 13 times in 12 hours. The central drive pin 5.11 is affixed to central disc 5.7 which then also revolves 13 times in 12 hours. Central disc 5.7 is positioned to mesh its gears with the gears of satellite disc 5.5 which is affixed to the underneath side of satellite disc 5.4, and satellite disc 5.4 is positioned to mesh its gears with the gears of the geared outer ring 5.10, as illustrated in FIG. 5*d* and FIG. 5*e*, such that as central disc 5.7 rotates 13 times in 12 hours the satellite discs unit 5.4 and 5.5 revolves about the geared outer ring 5.10 4 times in 12 hours, and revolves upon the geared outer ring 5.10 12 times in 12 hours.

The dimensions of each geared piece, i.e., (5.4)$=4n$, (5.5)$=24/7n$, (5.7)$=32/7n$, (5.10)$=12n$, are such that after 13/12 rotations of central disc 5.7 the satellite discs unit has made one full rotation upon the circumference of the geared outer ring 5.10. As the central discs unit 5.7 and 5.8 begins to rotate, with the hours indicator line 5.9 upon it, in the clockwise direction, the minutes indicator line 5.6, which is upon the satellite discs unit, begins to move in a counter clockwise direction (as illustrated by the directional arrows in FIG. 5*a*), such that by measuring the distance between the point where satellite disc 5.4 and the geared outer ring 5.10 make contact, and the point of the minutes indicator line 5.6 that is upon the circumference of satellite disc 5.4, it is possible to determine what portion of a full rotation the satellite discs unit has made upon the geared outer ring 5.10, and in that one full rotation of the satellite discs unit upon the geared outer ring 5.10 is equal to one hour it is then possible to determine what portion of an hour, i.e., how many minutes, has past since the minutes indicator line 5.6 was last in contact with the geared outer ring 5.10.

Figure 5A:
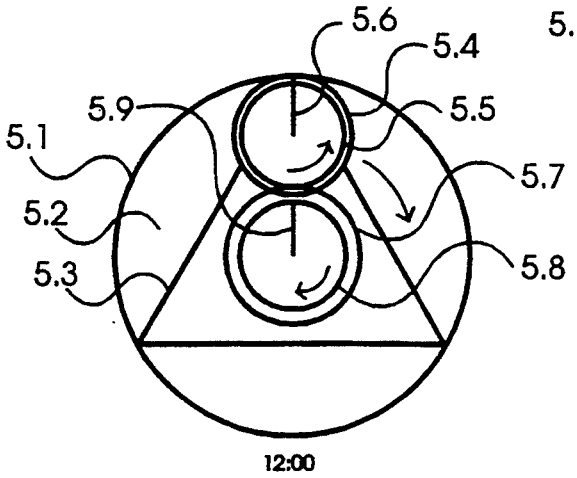
FIGS. 5*a*–5*d* contain frontal, cross sectional, geared and motive views of the fifth embodiment of the invention.
Figure 5B:
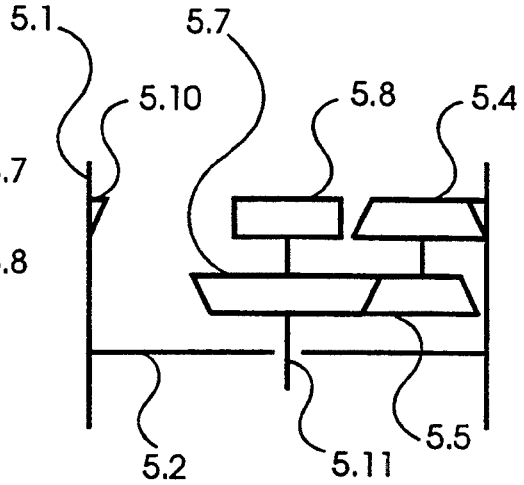
Figure 5C:
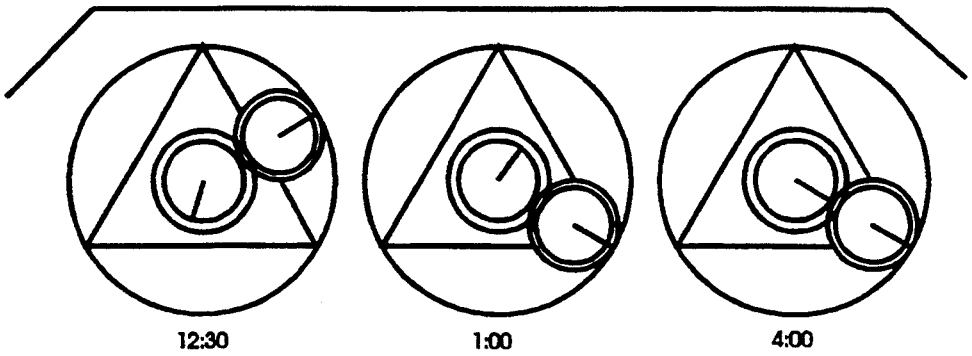
Figure 5D:
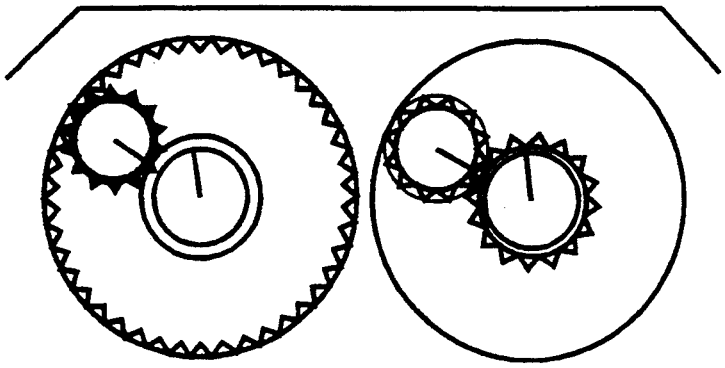

If both the minutes indicator line 5.6 and the hours indicator line 5.9 are pointing straight upward then the time is 12:00, as illustrated in FIG. 5*a*. After 13/12 rotations of the central discs unit from the 12:00 position, and therefore one full rotation of the satellite discs unit upon the the geared outer ring 5.10 from the 12:00 position, the hours indicator line 5.9 is pointing toward the fixed outer ring 5.1 exactly where the 1:00 position on a normal two hands clock would be and the minutes indicator line 5.6 is pointing toward the fixed outer ring 5.1 exactly where the 4:00 position on a two hands clock would be, and in combination these two indications mean that the time is 1:00, as illustrated in FIG. 5*c*. If the central discs unit makes another 13/12 rotation from its 1:00 position, and therefore the satellite discs unit makes a full rotation upon the geared outer ring 5.10 from its 1:00 position, then the hours indicator line 5.9 will be pointing toward the fixed outer ring 5.1 exactly where the 2:00 position would be on a normal two hands clock and the minutes indicator 5.6 will be pointing toward the fixed outer ring 5.1 exactly where the 8:00 position on a normal two hands clock would be, and on this clock the time is 2:00. As the satellite discs unit continues rotating in this fashion it begins to follow the pattern of an equilateral triangle 5.3 wherein the circumferential distance between each point of the triangle 5.3 upon the geared outer ring 5.10 is $4n$, and wherein each point of the triangle 5.3 corresponds to one of four fixed hours of the twelve hours of the clock.

To determine the hour, it is first necessary to determine how many minutes have elapsed as indicated by the rotation of the satellite discs unit upon the geared outer ring 5.10, and then to either count backward this number of minutes plus this number of minutes devided by 60, or forward the remaining number of minutes plus the remaining number of minutes devided by 60, starting at the point where the hours indicator line 5.9 is upon the circumference of central disc 5.8 and then moving around the circumference of central disc 5.8. The position subsequently arrived at will be one of the twelve hourly positions on a normal two hands clock, as fixed upon the circumference, and will correspond to the same hourly position on this clock. As measured upon the fixed outer ring 5.1, one hour or 60 minutes, is equal to 120° of the 360° circumference at any given moment, and because there is a repetition of hourly position by the minutes indicator 5.6 upon the fixed outer ring 5.1 every fourth hour, there is never a repetition of each hourly sequence upon the fixed outer ring 5.1 from one hour to the next, although the entire process repeats itself every twelve hours.

Because the satellite discs unit is free floating, it is necessary to hold it in its position between the central discs unit and the geared outer ring 5.10 by first inclining the rims of the two satellite discs such that their base circumferences are greater than their top circumferences, by then inclining the rim of central disc 5.7 in just the opposite fashion such that its base circumference is smaller than its top circumference, and by then inclining the rim of the geared outer ring so that its base circumference is greater than its top circumference. In this manner the satellite discs unit is held firmly flat while it is allowed to make its rotations, as illustrated in FIG. 5*b*.

The device in FIG. 6 is composed of:

(6.1) a fixed outer ring with a circumference greater than $5n$ plus the external circumference of the circular ring 6.3;

(6.2) a fixed base plate with a circumference equal to the fixed outer ring 6.1;

(6.3) a geared circular eccentric ring with an internal circumference of $12n$and an external circumference greater than $12n$;

(6.4) numerical or other indicia;

(6.5) a circular, geared eccentric disc with a circumference of less than $5n$;

(6.6) a fixed, circular, geared, concentric disc or fixed central disc with a circumference of $7n$;

(6.7) a connecting piece between central drive pin 6.9 and eccentric drive pin 6.8 measuring $3.5n$plus the radius of eccentric disc 6.5 plus the external circumference of circular ring 6.3 minus $12n$;

(6.8) an eccentric drive pin;

(6.9) a central drive pin.

The device functions as the drive mechanism (not illustrated) revolves the central drive pin 6.9 12 time in 12 hours. The central drive pin 6.9 runs up through the fixed central disc 6.6 and is affixed to the eccentric drive pin 6.8 by a connecting piece 6.7, which then also revolves 12 times in twelve hours. The eccentric drive pin 6.8 runs down through eccentric disc 6.5 forcing it to revolve 12 times in 12 hours and to mesh its gears with the gears on the external side of the circular geared eccentric ring 6.3. The eccentric ring 6.3 is held firmly between eccentric disc 6.5 and the fixed central disc 6.6 and is forced to mesh its external gears with the gears of eccentric disc 6.5 (as already mentioned) and to mesh its internal gears with the gears of the fixed central disc 6.6, as illustrated in FIG. 6*d*. As such the eccentric ring 6.3 will revolve upon one entire circumference of the fixed central disk 6.6 7 times in 12 hours and will make 7 revolutions in 12 hours about the fixed space of the fixed central disk 6.6.

The dimensions of the internal circumference of the eccentric ring 6.3, i.e., $12n$, and the fixed central disc 6.6, i.e., $7n$, are such that after one rotation of eccentric disc 6.5 the eccentric ring 6.3 has revolved 7/12 of its internal circumference upon the fixed central disc 6.6. One revolution of eccentric disc 6.5 is equal to one hour, as on a normal clock, and therefore 60 minutes are determined with the same time positions a normal minutes hand of a two hands clock would use.

Figure 6A:
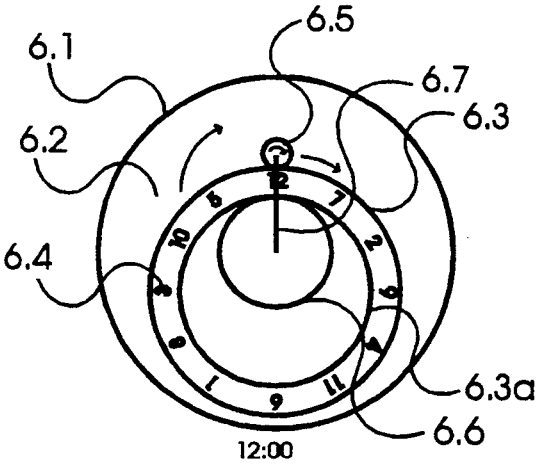
FIGS. 6*a*–6*d* contain frontal, cross sectional, geared and motive views of the sixth embodiment of the invention.
Figure 6B:
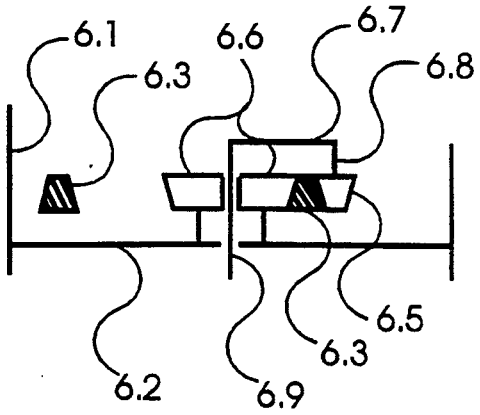
Figure 6C:
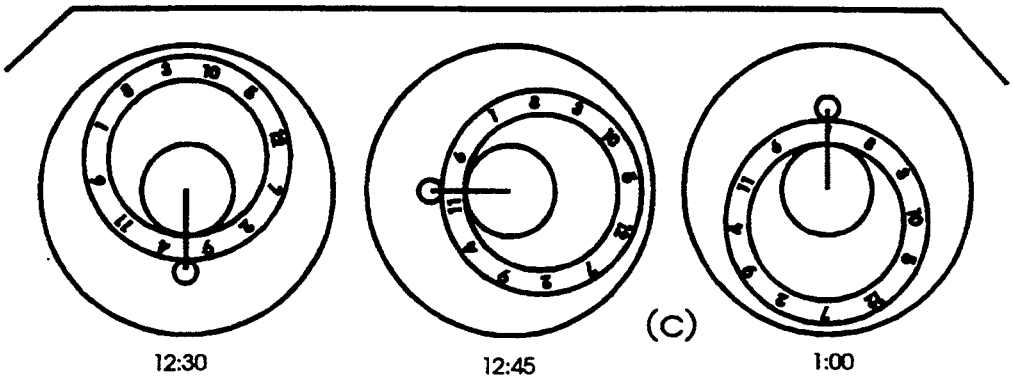
Figure 6D:
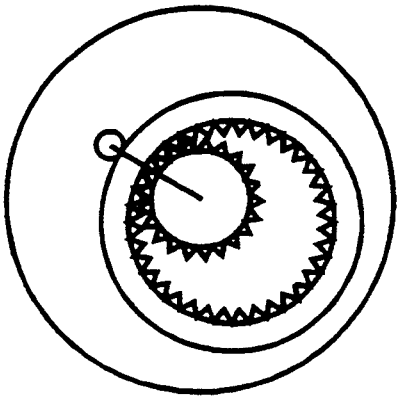

If eccentric disc 6.5 is pointing straight upward and the 12:00 position of the eccentric ring 6.3 is upon the upper most part of the circumference of the fixed central disc 6.6 then the time is 12:00, as illustrated in FIG. 6*a*. After one full revolution of eccentric disc 6.5 in the clockwise direction from the 12:00 position eccentric disc 6.5 is again pointing straight upward and the eccentric ring 6.3 has revolved one time upon the entire circumference of the fixed central disc 6.6 and made 7/12 of a revolution about the fixed space of the fixed central disc 6.6 in the clockwise direction, such that its 1:00 position is now upon the upper most part of the circumference of the fixed central disc 6.6, and the time is 1:00, as illustrated in FIG. 6*c*. If eccentric disc 6.5 revolves away from the 1:00 position its next full revolution will be again pointing upward and the eccentric ring 6.3 will have its 2:00 position also pointing upward signifying that the time is 2:00. As eccentric disc 6.5 continues to revolve once every hour the eccentric ring 6.3 continues to rotate upon the fixed central disc 6.6 7/12 of its inner circumference once every hour. In this fashion the eccentric ring 6.3 begins to follow the pattern of a twelve sided star wherein each point of the star corresponds to one of the twelve hours of the clock and wherein the circumferential distance between each consecutive hour as being represented by points of the star upon the inner circumference of the eccentric ring 6.3 is equal to $7n$.

To determine the hour, it is first necessary to determine how many minutes have elapsed as indicated by the position of eccentric disc 6.5 to the fixed central disc 6.6, and then from the position of eccentric disc 6.5 upon the eccentric ring 6.3 to count either backward this number of minutes or forward the remaining number of minutes using the indicia 6.4 labeled upon the eccentric ring 6.3. Between each indicia there are 8.57 or 60/7 minutes, and therefore between 7 indicia there is one hour. As measured upon the eccentric ring 6.3, one hour or 60 minutes is equal to 210° of its 360° circumference at any given moment.

Because the eccentric ring 6.3 is free floating it is necessary to first incline the internal and external rims of the eccentric ring 6.3 so that their base circumferences are greater than their top circumferences, to then incline the rim of eccentric disc 6.5 so that its base circumference is smaller than its top circumference and to then incline the rim of the fixed central disc 6.6 so that its base circumference is also smaller than its top circumference. In this manner the eccentric ring 6.3 is held firmly flat by both the eccentric disc 6.5 and the fixed central disc 6.6 while it is allowed to make its rotations, as illustrated in FIG. 6*b*.

It is considered that the geared relationship between eccentric disc 6.5 and the external circumference of the eccentric ring 6.3 may not be necessary, and that contact of smooth surfaces between these two parts may suffice to enact the action of the mechanism.

The device in FIG. 7 is composed of:

(7.1) a fixed outer ring with a circumference of 12*n*;
(7.2) a fixed base plate with a circumference of 12*n*;
(7.3) fixed hours indicator lines upon base plate 7.2;
(7.4) fixed minutes indicator lines upon base plate 7.2;
(7.5) a geared eccentric disc with a circumference of 9*n*;
(7.6) an equilateral triangle inscribed within the circumference of eccentric disc 7.5;
(7.7*a,b,c*) three optically different equilateral triangles forming the three angles of equilateral triangle 7.6;
(7.8) a fixed geared outer ring with a circumference of 12*n*;
(7.9) an eccentric drive pin;
(7.10) a connecting piece between eccentric drive pin 7.9 and central drive pin 7.11 measuring 1.5*n*;
(7.11) a central drive pin.

Figure 7A:
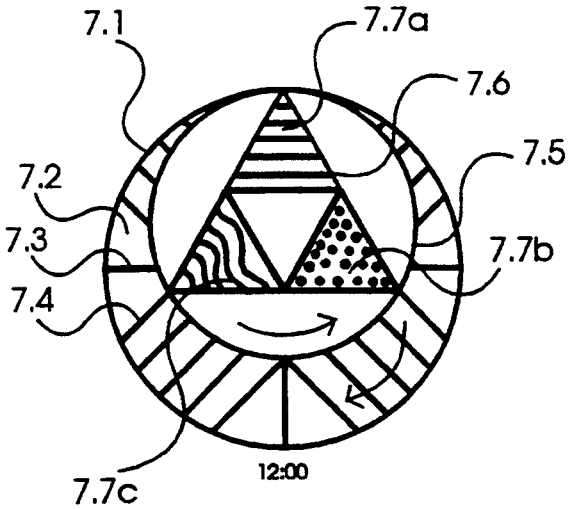
FIGS. 7*a*–7*d* contain frontal, cross sectional, geared and motive views of the seventh embodiment of the invention.
Figure 7B:
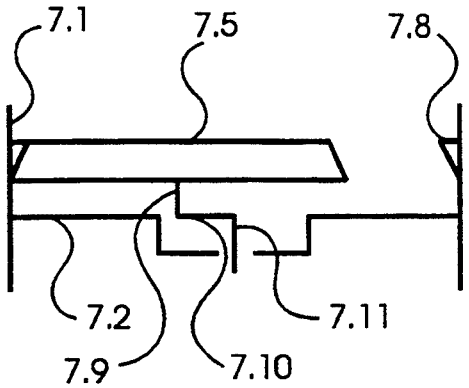
Figure 7C:
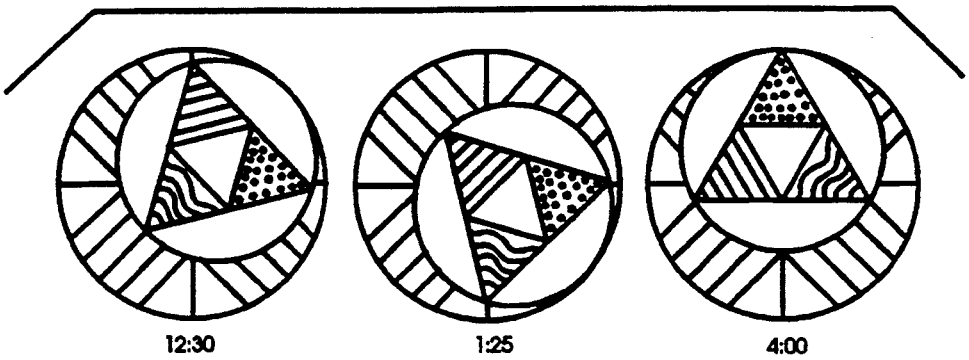
Figure 7D:
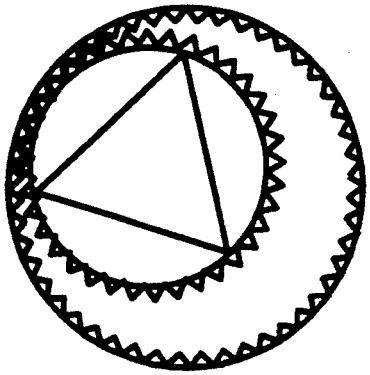

The device functions as the drive mechanism (not illustrated) revolves the central drive pin 7.11 3 rotations in 12 hours. The central drive pin 7.11 is affixed to the eccentric drive pin 7.9 by a connecting piece 7.10, and the eccentric drive pin 7.9 then also revolves 3 times in 12 hours. The eccentric drive pin 7.9 runs up through eccentric disc 7.5 forcing eccentric disc 7.5 to mesh its gears with the gears of the geared outer ring 7.8, as illustrated in FIG. 7d, and revolve in eccentric fashion 3 times in 12 hours about the circumference of the geared outer ring 7.8 and 4 times in 12 hours upon the circumference of the geared outer ring 7.8.

The dimensions of each geared piece, i.e., (7.5)=9*n*, (7.8)=12*n*, are such that after $\frac{1}{4}$ rotations of the central drive pin 7.11, and therefore the eccentric drive pin 7.9, eccentric disc 7.5 makes $\frac{1}{3}$ rotations upon the geared outer ring 7.8. As eccentric disc 7.5 revolves about the geared outer ring 7.8 in the clockwise direction, the equilateral triangle 7.6 moves in a counter clockwise direction, as illustrated by the directional arrows in FIG. 7*a*, such that the points of its angles traverse the four fixed groups of minutes indicator lines 7.4, which are upon the fixed base plate 7.2, as well as make contact with the points where the four fixed hours indicator lines 7.3, also upon the fixed base plate 7.2, meet the fixed outer ring 7.1.

Minutes are determined by the position of the point of the equilateral triangle 7.6, which is furthest from the circumference of the fixed outer ring 7.1, with respect to the 5 fixed minutes indicator lines 7.4 it is traversing, such that it begins at the first minutes indicator line with 0 minutes, and then between the first and second lines there are 15 minutes, between the first and third lines there are 30 minutes, etc. When it has reached the fifth line then one hour has past and the next triangle point begins to traverse the next set of minutes indicator lines (see FIG. 7*c*).

Hours are determined by the positions of the three optically different equilateral triangles 7.7*a,b,c*, with respect to the four fixed hours indicator lines 7.3. If triangle 7.7*a* is pointing straight upward so that its point upon the circumference of eccentric disc 7.5 is in contact with the point where the top center hours indicator line, or first hours indicator line, meets the fixed outer ring, then the time is 12:00, as illustrated in FIG. 7*a*. As eccentric disc 7.5 begins to revolve about the geared outer ring 7.8, in the clockwise direction away from the 12:00position, the next $\frac{1}{3}$ rotation it makes upon the geared outer ring 7.8, and therefore the next $\frac{1}{4}$ rotation it makes about the geared outer ring 7.8, will bring the outer point of triangle 7.7*b* to the second hours indicator line, and this is the 1:00 position. After a full revolution about the circumference of the geared outer ring 7.8, triangle 7.7*b* will be pointing straight up toward the first hours indicator line, and the time will be 4:00 as illustrated in FIG. 4*c*. As eccentric disc 7.5 continues to make its revolutions about the geared outer ring 7.8 each point of triangle 7.6 and each external point of the four hours indicator lines 7.3 will meet once in twelve hours with each of the twelve meetings corresponding to each of the twelve hours of the clock. It is also possible to tell hours by using the positions of the three triangles relative to the positions of the four fixed sets of minutes indicator lines 7.4. As measured upon the fixed outer ring 7.1, one hour or 60 minutes is equal to 90° of the 360° circumference at any given moment, and because there is a repetition of the hourly position upon the fixed outer ring 7.1 every four hours, there is never a repetition of the position of each hourly sequence from one hour to the next, although the entire process repeats itself every twelve hours.

Because the relationship between the eccentric drive pin 7.9, eccentric disc 7.5 and the geared outer ring 7.8 may be an unstable one it is necessary to first incline the rim of the eccentric disc so that its base circumference is greater than its top circumference, and to then incline the rim of the geared outer ring so that its base circumference is also greater than its top circumference. In this manner the eccentric disc is held firmly flat while it is allowed to make its rotations, as illustrated in FIG. 7*b*.

Figure 8A:
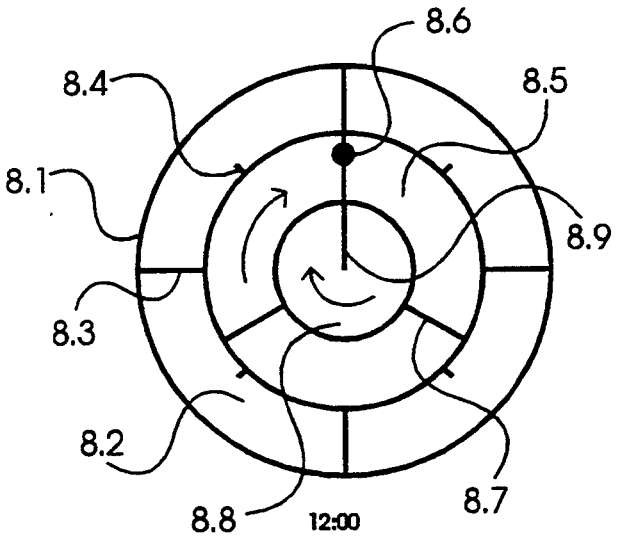
FIGS. 8*a*–8*c* contain frontal, cross sectional and motive views of the eighth embodiment of the invention.
Figure 8B:
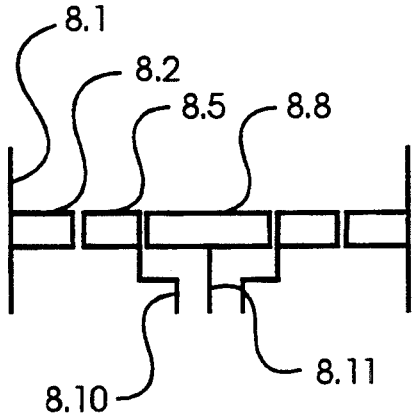

The device in FIG. 8 is composed of:

(8.1) a fixed outer ring with a circumference of 12*n*;
(8.2) a fixed concentric ring with an external circumference of 12*n* and an internal circumference of 8*n*;
(8.3) 4 full indicator lines;
(8.4) 4 half indicator lines;
(8.5) a concentric ring with an external circumference of 8*n* and an internal circumference of 4*n*;
(8.6) an hours indicator dot;
(8.7) 3 indicator lines;
(8.8) a concentric circular disc or central disc with a circumference of 4*n*;
(8.9) a minutes indicator line;
(8.10) a hollow central drive pin;
(8.11) a central drive pin.

The device functions as the drive mechanism (not illustrated) revolves the central drive pin 8.11 13 rotations in 12 hours, and the hollow drive pin 8.10 one rotation in 12 hours. The central drive pin 8.11 runs up through the hollow drive pin 8.10 and is affixed to central disc 8.8, which then also revolves 13 times in 12 hours. The hollow drive pin 8.10 is affixed to concentric ring 8.5, which then also revolves one time in 12 hours. Both ring 8.5 and the central disc 8.8 rotate in the clockwise direction as illustrated by the directional arrows in FIG. 8*a*.

Upon fixed ring 8.2 there are 4 full indicator lines 8.3 each separated by 90° of the circumference of ring 8.2 and the first of which is at the top center(or 12:00 position) of ring 8.2, the second of which is 90° in the clockwise direction from the first, etc. Upon ring 8.2 there are also 4 half indicator lines 8.4 each separated by 90° of the circumference of ring 8.2 and the first of which is 45° in the clockwise direction from the top center of ring 8.2, the second of which is 90° in the clockwise direction from the first, etc. Upon concentric ring 8.5 there are three indicator lines 8.7 each separated by 120° of the circumference of ring 8.5 and the first of which has an indicator dot 8.6 upon it, the second of which is 120° in the clockwise direction from the first, etc. Upon the central disc 8.8 there is one indicator line 8.9, as illustrated in FIG. 8*a*.

Figure 8C:
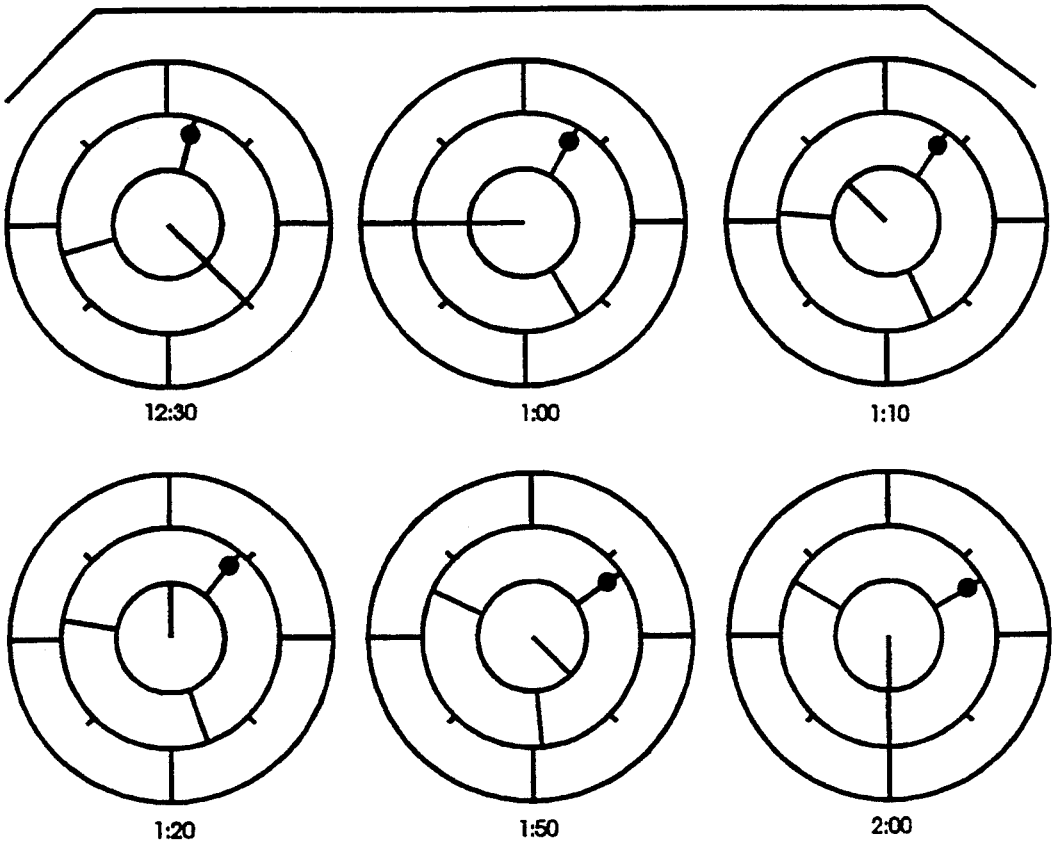

If the indicator dot 8.6 upon ring 8.5 and its line are pointing straight up toward the first of the 4 full indicator lines on ring 8.2, and the indicator line 8.9 upon the central disc 8.8 is pointing straight up toward both of these lines so that there is one straight line running from the center of the central disc 8.8 to the top center of the external circumference of fixed ring 8.2, then the time is 12:00, as illustrated in FIG. 8*a*. As the central disc 8.8 makes a $\frac{3}{4}$ rotation from the 12:00 position so that its indicator line 8.9 is in line with the fourth full indicator line on fixed ring 8.2, ring 8.5 makes a 1/12 rotation so that its third indicator line is in line with both the fourth full indicator line on fixed ring 8.2 and the indicator line 8.9 on the central disc 8.8. In this position the indicator dot 8.6 and line upon ring 8.5 are in the 1:00 position of a normal two hands clock, and the time is 1:00 as illustrated in FIG. 8*c*. As the central disc 8.8 continues to rotate its indicator line 8.9 passes the half indicator lines 8.4 and the full indicator lines 8.3 on fixed ring 8.2, and the 45° difference between each full and half indicator line as measured upon the circumference of fixed ring 8.2 represents 10 minutes, so that after a 45° rotation, or a $\frac{1}{8}$ rotation, of the central disc 8.8 from the 1:00 position its indicator line 8.9 is pointing to the fourth half indicator line on fixed ring 8.2, and ring 8.5 has made 1/72 rotations. In this position the time is 1:10, as illustrated in FIG. 8*c*. The central disc 8.8 then continues to make its $\frac{3}{4}$ rotations every hour passing the indicator lines 8.3 and 8.4 upon fixed ring 8.2 with its indicator line 8.9 every 10 minutes, and ring 8.5 continues to make its one rotation every 12 hours with its indicator lines 8.7 passing the full indicator lines 8.3 on ring 8.2 every hour.

To determine the hours it is necessary to find where the indicator dot 8.6 on ring 8.5 is in relation to fixed ring 8.2, and in that ring 8.5 moves as the hour hand on a normal two hands clock would move the hour is determined in the same fashion.

To determine the minutes it is necessary to determine which of the three indicator lines 8.7 on ring 8.5 was last in contact with one of the full indicator lines 8.3 on fixed ring 8.2 and which of the indicator lines 8.3 on ring 8.5 will next be in contact with one of the full indicator lines 8.3 on fixed ring 8.2. With this information it is possible to determine how many minutes the indicator line 8.9 on the central disc 8.8 has rotated past the old contact point between the indicator lines on rings 8.2 and 8.5, or how many minutes it will need to rotate until it will arrive at the new contact point between the indicator lines on rings 8.2 and 8.5, using its relationship with the indicator lines 8.3 and 8.4 on fixed ring 8.2 as described in a previous paragraph.

As measured by the indicator line 8.9 upon the central disc 8.8, one hour or 60 minutes is equal to 270° of the 360° circumference of fixed ring 8.2 at any given moment, and because there is a repetition of hourly position by the indicator line 8.9 every fourth hour, there is never a repetition of the hourly sequence upon fixed ring 8.2 from one hour to the next, although the entire process repeats itself every 12 hours.

The device in FIG. 9 is composed of:

(9.1) a fixed outer ring with a diameter of n;

(9.2) a fixed inner geared ring with a diameter of m such that $m=n-x+y$;

(9.3) a fixed base plate with a diameter of n;

(9.4) a circular, geared concentric disc or satellite disc with a diameter of c such that $c=(n/2)-(y/2)$;

(9.5) a circular, geared eccentric disc or satellite disc with a diameter of d such that $d=(m/2)-(x/2)$;

(9.6) a circular geared concentric disc or central disc with a diameter of x such that $x=[m(y+1)]/(n-1)$;

(9.7) a circular, geared concentric disk or central disc with a diameter of y such that $y=z$;

(9.8) point q on the fixed outer ring 9.1;

(9.9) point z on the fixed outer ring 9.1 which is the circumferential distance, as measured in the clockwise direction about the fixed outer ring 9.1 from point q, where the hourly position will be if point q was the previous hourly position;

(9.10) an indicator line on central disc 9.7;

(9.11) a fixed geared outer ring with a diameter of n;

(9.12) a central drive pin.

This mechanism can also be constructed wherein $m=n$. Examples of solutions to the mechanism wherein m is not equal to n are as follows: a) $n=96$, $m=88$, $c=19$, $d=11$, $x=66$, $y=58$, $z=58$, or b) $n=48$, $m=44$, $c=15$, $d=11$, $x=22$, $y=18$, $z=18$. Examples of solutions to the mechanism wherein $m=n$ are as follows: a) $n=96$, $m=96$, $c=19$, $d=12$, $x=72$, $y=58$, $z=58$, or b) $n=48$, $m=48$, $c=15$, $d=12$, $x=24$, $y=18$, $z=18$.

Figure 9A:
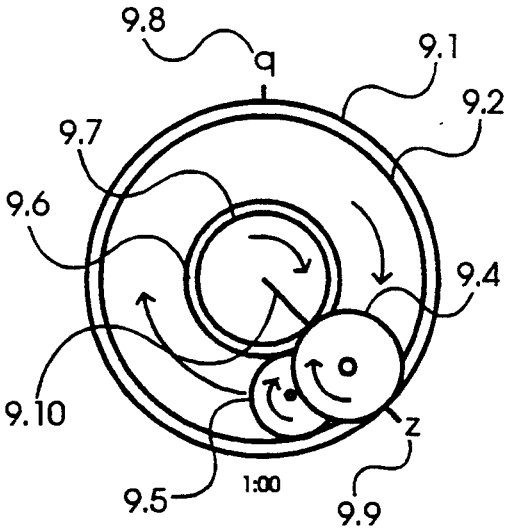
FIGS. 9*a*–9*d* contain frontal, cross sectional, geared and motive views of the ninth embodiment of the invention.
Figure 9B:
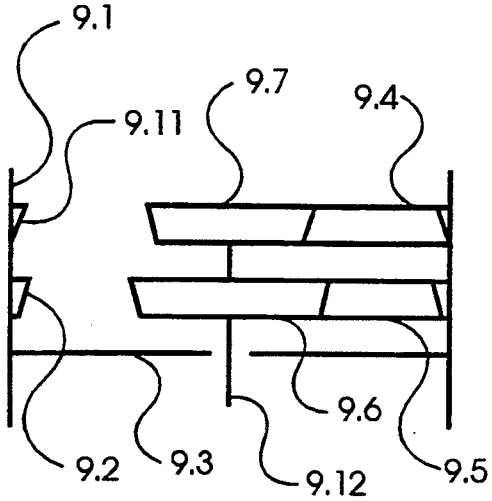

The device functions as the drive mechanism (not illustrated) revolves the central drive pin 9.12 $[n+y]/n$ rotations in one hour. The central drive pin 9.12 is affixed to central discs 9.6 and 9.7, which then also revolve $[n+y]/n$ rotations in one hour. Central disc 9.6 is positioned to mesh its gears with the gears of satellite disc 9.5, and central disc 9.7 is positioned to mesh its gears with the gears of satellite disc 9.4. Satellite disc 9.5 then meshes gears with both the gears of central disc 9.6 and the geared inner ring 9.2, and satellite disc 9.4 meshes its gears with the gears of central disc 9.7 and the geared outer ring 9.11, as illustrated in FIG. 9*d*.

The dimensions of each geared piece are such that after $[n+y]/n$ rotations of the central discs unit, satellite disc 9.4 has made z rotations about the circumference of the geared outer ring 9.11, and satellite disc 9.5 has made the equivalent of $z+30°$ of the 360° circumference of the fixed outer ring 9.1 rotations (as measured upon the circumference of the fixed outer ring 9.1), as it revolves about the circumference of the geared inner ring 9.2. As the central discs unit begins to rotate with the indicator line 9.10 in the clockwise direction, the satellite discs begin to revolve about their respective geared rings also in the clockwise direction, although their revolutions upon the geared rings are in the counter clockwise direction as illustrated by the directional arrows in FIG. 9*a*. By measuring the distance between the point where satellite disc 9.4 and central disc 9.7 make contact, and the point of the indicator line 9.10 which is upon the circumference of central disc 9.7, it is possible to determine what portion of a full rotation central disc 9.7 has made with respect to satellite disc 9.4, and in that one full rotation of central disc 9.7 with respect to satellite disc 9.4 is equal to one hour it is possible to determine what portion of an hour, i.e., how many minutes, has past since the indicator line 9.10 was last in contact with satellite disc 9.4.

Figure 9C:
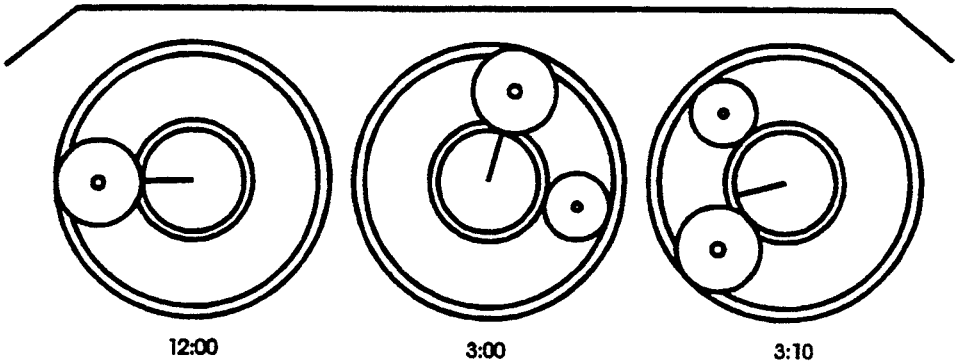
Figure 9D:
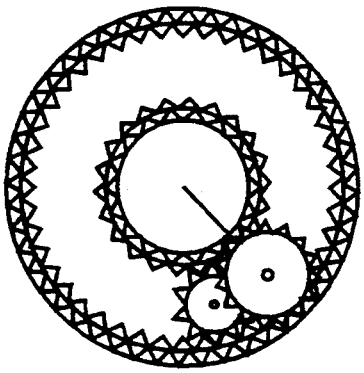

If the indicator line is pointing directly at satellite disc 9.4 and satellite disc 9.5 is directly underneath satellite disc 9.4 then the time is 12:00, as illustrated in FIG. 9*c*. After $[z+n]/n$ rotations of the central discs unit, and therefore one hour, the indicator line on central disc 9.7 is again pointing directly at satellite disc 9.4 and satellite disc 9.5 is 30° of the 360° circumference of the fixed outer ring 9.1 ahead of satellite disc 9.4 in the clockwise direction, and the time is 1:00 as illustrated in FIG. 9*a*. As this process continues, satellite disc 9.5 continually gains 30° of the 360° circumference of the fixed outer ring 9.1 each hour relative to position z of satellite disc 9.4, such that after 12 hours it is again directly underneath satellite disc 9.4.

To determine hours it is necessary to determine the distance between satellite disc 9.4 and satellite disc 9.5. Every 30° represents one of 12 hours on a 360° circumference as on a normal two hands clock, and in that each hour gained means a gain of 30° of a 360° circumference by satellite disc 9.5 over satellite disc 9.4, the number of 30° sections contained in the distance that satellite disc 9.5 has gained over satellite disc 9.4 in the clockwise direction determines the number of the hour.

This clock is designed such that it is possible to find a number z wherein the ensuing measurements of each piece as determined by the number z will create a functioning relationship between the pieces that will allow the clock to represent the minutes and hours of a 12 hour system but that for the life of the functioning of the clock will never allow the positions of its times on the fixed outer ring 9.1 to ever be repeated, i.e., infinity.

Because the satellite discs are free floating, it is necessary to hold them in their positions between the central discs unit and the geared rings unit by first inclining their rims so that their base circumferences are greater than their top circumferences, to then incline the rims of the central discs such that their base circumferences are smaller than their top circumferences, and to then incline the rims of the geared rings such that their base circumferences are greater than their top circumferences. In this manner the satellite discs are held firmly flat while they are allowed to make their rotations, as illustrated in FIG. 9*b*.

The device in FIG. 10 is composed of:

(10.1) an upper concentric circular disc with a circumference of n;

(10.2) a circular window with a circumference of $\frac{1}{2}n$upon disc 10.1;

(10.3 ) optical zone one of disc 10.1;

(10.4) optical zone two of disc 10.1;

(10.5) optical zone three of disc 10.1;

(10.6) optical zone four of disc 10.1;

(10.7) a lower concentric circular disc with a circumference of n;

(10.8) optical zone one of disc 10.7;

(10.9) optical zone two of disc 10.7;

(10.10) optical zone three of disc 10.7;

(10.11) optical zone four of disc 10.7;

(10.12) a fixed outer ring with a circumference greater than n;

(10.13) a hollow central drive pin;

(10.14) a central drive pin.

The device functions as the drive mechanism (not illustrated) revolves the central drive pin 10.14 one rotation in 12 hours and the hollow drive pin 10.13 13 rotations in 12 hours. The central drive pin 10.14 runs up through the hollow drive pin 10.13 and is affixed to the upper concentric disc 10.1, which then also revolves once in 12 hours. The hollow drive pin 10.13 is affixed to the lower concentric disc 10.7, which then revolves 13 times in 12 hours. Both discs rotate in the clockwise direction as illustrated by the directional arrows in FIG. 10*c*.

Figure 10A:
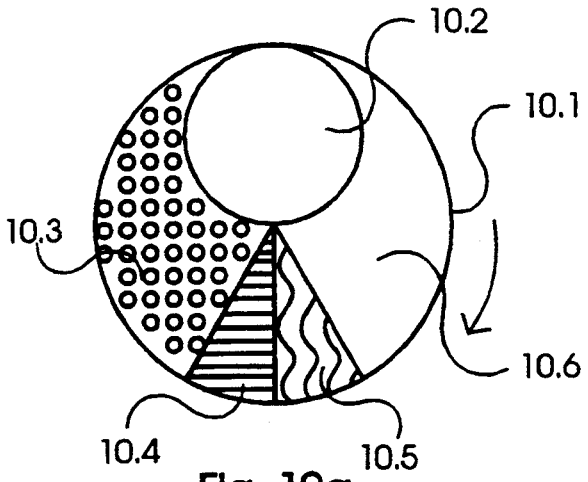
FIGS. 10*a*–10*e* contain frontal, cross sectional and motive views of the tenth embodiment of the invention.
Figure 10B:
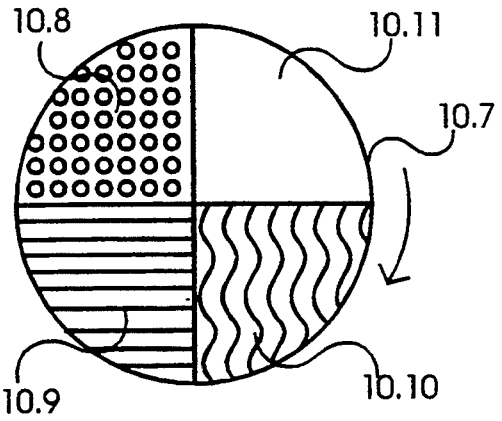

Upon disc 10.1 there are four optically different zones 10.3, 10.4, 10.5, 10.6, and one circular window 10.2, and upon disc 10.7 there are also four optically different zones 10.8, 10.9, 10.10, 10.11. One of each of the four optically different zones on disc 10.1 is optically identical to one of each of the optically different zones on disc 10.7, as illustrated in Figs. 10*a* and 10*b*. As disc 10.1 rotates once in 12 hours, disc 10.7 rotates below disc 10.1 13 times in 12 hours such that one of each of the boundary lines separating the optical zones on both discs are in alignment with each other every 5 minutes.

Figure 10C:
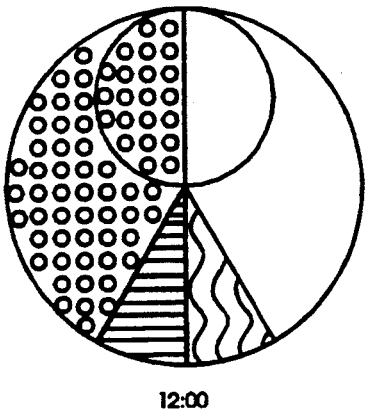
Figure 10D:
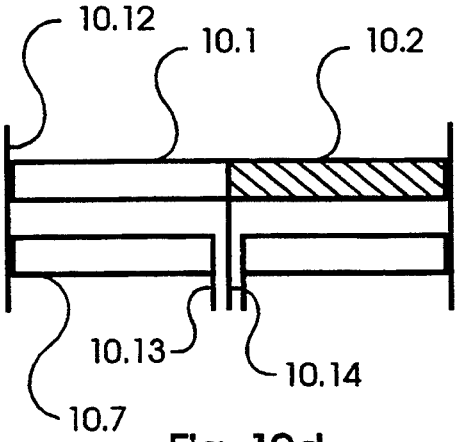
Figure 10E:
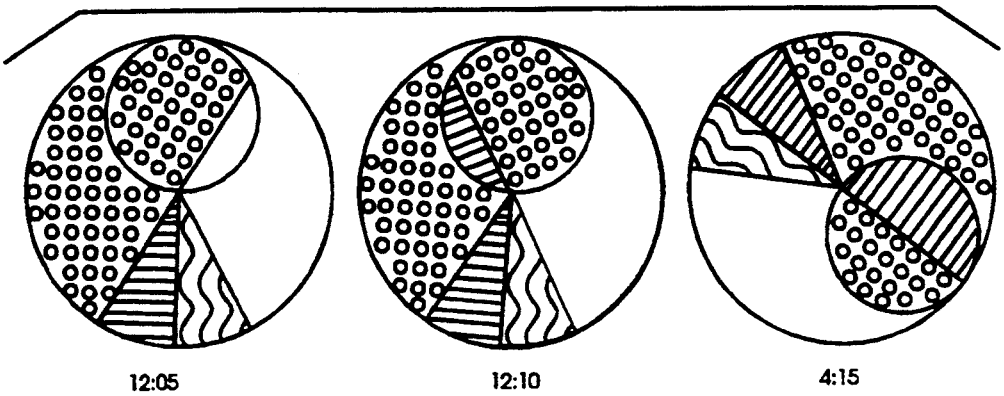

If the window 10.2 on disc 10.1 and the line separating optical zones 10.8 and 10.11 on disc 10.7 are pointing directly upward, as illustrated in FIG. 10*c*, then the time is 12:00. As disc 10.1 rotates away from the 12:00 position, disc 10.7 also rotates away so that after 5 minutes the line on disc 10.7 separating zones 10.8 and 10.11 is aligned with the line on disc 10.1 separating zones 10.4 and 10.5, and the time is 12:05, as illustrated in FIG. 10*e*. As the two discs continue to rotate the next linear alignment will be between the line on disc 10.7 separating zones 10.9 and 10.10, and the line on disc 10.1 separating zones 10.5 and 10.6, and the time will be 12:10 (see FIG. 10*e*). The same line on disc 10.7 will then align with the line on disc 10.1 separating zones 10.4 and 10.5 at 12:15. This process continues until all four lines on disc 10.7, passing below the window 10.2 on disc 10.1, have aligned once with all three lines on disc 10.1, at which point an hour has past and disc 10.1 is positioned in the 1:00 position, and ready for the same sequence on disc 10.7 to again pass below its window.

To determine hours, it is necessary to determine where the window 10.2 on disc 10.1 is pointing. Disc 10.1 rotates in the same manner as the hour hand on a normal two hands clock, and therefore it tells the hour using the same hourly positions as a normal clock and indicates with the external most point of its window.

To determine the minutes, it is first necessary to determine which optical zone or zones on disc 10.7 are passing below the window 10.2 on disc 10.1. Since the order of optical zones on disc 10.1 is the same as the order of the optical zones on disc 10.7 it is possible to determine which zone on disc 10.7 began the hour and which zones are following. Each alignment with a line on disc 10.7 and the line on disc 10.1 which separates zones 10.4 and 10.5, or the central line, is $\frac{1}{4}$ of an hour, therefore it is necessary to coordinate the quarter hours with the different optical zones and then with the different points of 5 minute alignments. In this manner the indication of minutes is entirely dependant upon the relationship between the two discs wherein one disc continually completes and changes the pattern of the other.

The device in FIG. 11 is composed of:

(11.1) an upper concentric circular disc with a circumference of n;

(11.2) a circular window with a circumference less than $\frac{1}{2}n$ upon disc 11.1;

(11.3) indicator line one;

(11.4) indicator line two;

(11.5) indicator line three;

(11.6) indicator line four;

(11.7) indicator line five;

(11.8) indicator line six;

(11.9) a lower concentric circular disc with a circumference of n;

(11.10) an indicator pattern on disc 11.9;

(11.11) a fixed outer ring;

(11.12) a hollow central drive pin;

(11.13) a central drive pin.

The device functions as the drive mechanism (not illustrated) revolves the central drive pin 11.13 one rotation in 12 hours and the hollow drive pin 11.12 13 rotations in 12 hours. The central drive pin 11.13 runs up through the hollow drive pin 11.12 and is affixed to the upper concentric disc 11.1, which then also revolves once in 12 hours. The hollow drive pin 11.12 is affixed to the lower concentric disc 11.9, which then revolves 13 times in 12 hours. Both discs rotate in the clockwise direction as illustrated by the directional arrows in FIG. 11*c*.

Upon disc 11.1 there are six indicator lines 11.4, 11.4, 11.5, 11.6, 11.7, 11.8, and one circular window 11.2, and upon disc 11.9 there is a rectangular indicator pattern 11.10 with two optically different sides. As the indicator pattern 11.10 on disc 11.9 passes below the window 11.2 of disc 11.1 the lines of its edges align with the indicator lines on disc 11.1 every 5 minutes, except at 30 minutes when the bottom edge of the indicator pattern 11.10 is parallel to indicator lines 11.3 and 11.8 on disc 11.1 but not in alignment with them.

Figure 11A:
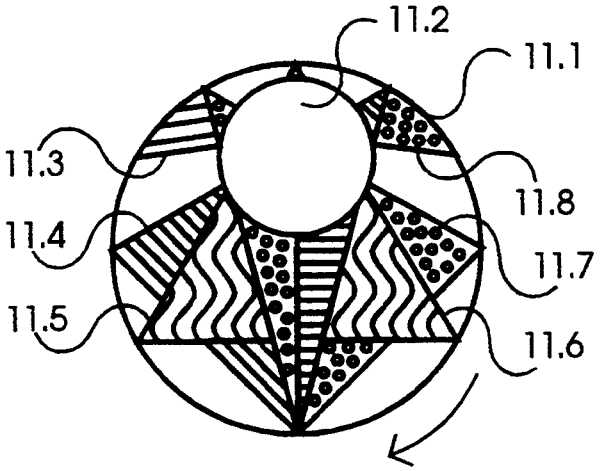
FIGS. 11*a*–11*e* contain frontal, cross sectional and motive views of the eleventh embodiment of the invention.
Figure 11B:
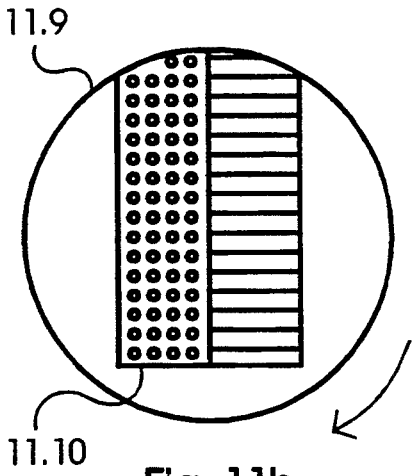
Figure 11C:
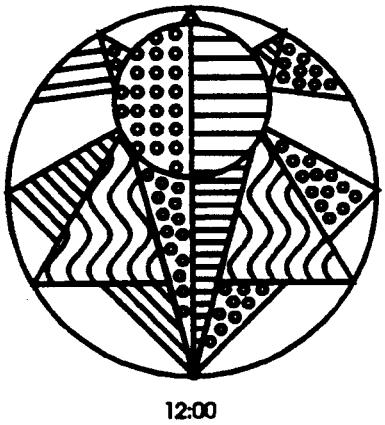
Figure 11D:
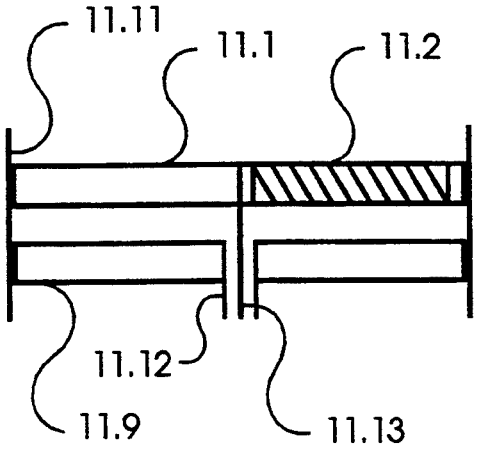
Figure 11E:
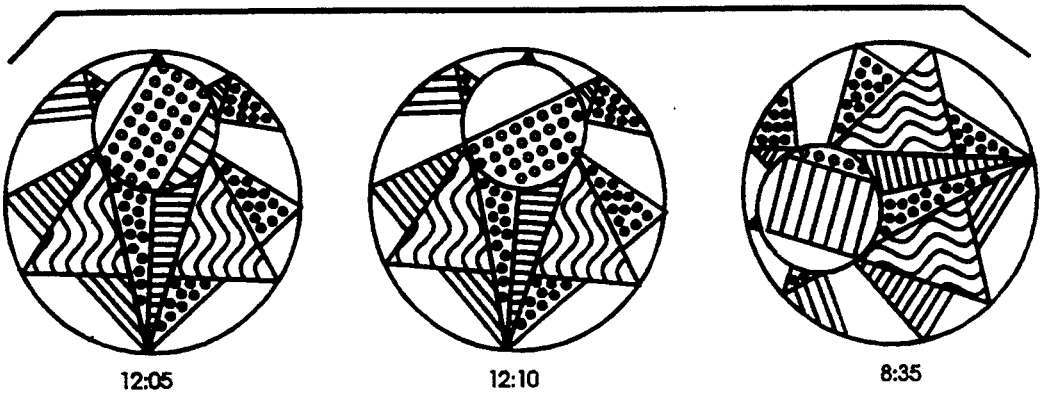

If the window 11.2 on disc 11.1 and the upper end of the line separating the two optically different sides on disc 11.9 are pointing directly upward, as illustrated in FIG. 11*c*, then the time is 12:00. As disc 11.1 rotates away from the 12:00 position, disc 11.9 also rotates away so that after five minutes the left edge of the indicator pattern 11.10 on disc 11.9 is aligned with line 11.5 on disc 11.1 and the time is 12:05, as illustrated in FIG. 11*e*. As the two discs continue to rotate the next alignment will be between the left edge of 11.10 and line 11.4, and the time will be 12:10 (see FIG. 11*e*). At 12:15 the left edge of 11.10 will be aligned with lines 11.3 and 11.8. At 12:30 the bottom edge of 11.10 will be just beyond lines 11.3 and 11.8, and then from 12:30 until 1:00 the right edge of 11.10 will align with the lines on disc 11.1 until it is 1:00, and the process will repeat itself in the next hour etc.

To determine hours, it is necessary to determine where the window 11.2 on disc 11.1 is pointing. Disc 11.1 rotates in the same manner as the hour hand on a normal two hands clock, and therefore it tells the hour using the same hourly positions as a normal clock and indicates with the external most point of its window 11.2.

To determine the minutes, it is first necessary to determine which edge of 11.10 is passing below the window 11.2 on disc 11.1 by using the two optically different sides on 11.10. Then it is necessary to determine which indicator line on disc 11.1 the edge is in line with, was in line with or is about to be in line with, and this will indicate the minute. In this manner the indication of minutes is entirely dependant upon the relationship between the two discs wherein one disc continually completes and changes the pattern of the other.

The device in FIG. 12 is composed of:

(12.1) an upper concentric circular disc with circumference n;

(12.2) a semi-circular window with a radius of n/2pi;

(12.3) an hours indicator line;

(12.4) a 5 minutes indicator line;

(12.5) a 10 minutes indicator line;

(12.6) a half rectangle for indicating quarter hours;

(12.7) a lower concentric circular disc with circumference n;

(12.8) four minutes indicator lines;

(12.9) a full rectangle for indicating quarter hours;

(12.10) a fixed outer ring;

(12.11) a hollow central drive pin;

(12.12) a central drive pin.

The device functions as the drive mechanism (not illustrated) revolves the central drive pin 12.12 one rotation in 12 hours and the hollow drive pin 12.11 13 rotations in 12 hours. The central drive pin 12.12 runs up through the hollow drive pin 12.11 and is affixed to the upper concentric disc 12.1, which then also revolves once in 12 hours. The hollow drive pin 12.11 is affixed to the lower concentric disc 12.7, which then revolves 13 times in 12 hours. Both discs rotate in the clockwise direction as illustrated by the directional arrows in FIG. 12*c*.

Upon disc 12.1 there is an hours indicator line 12.3, a 5 minutes indicator line 12.4, a 10 minutes indicator line 12.5 and a half rectangle 12.6 to indicate the quarter hours. Upon disc 12.7 there are four minutes indicator lines 12.8 and one full rectangle 12.9 to indicate the quarter hours. As disc 12.1 rotates once in 12 hours, disc 12.7 rotates below disc 12.1 13 times in 12 hours such that the lines 12.8 on disc 12.7 alternate between being in alignment with the 5 minutes indicator line 12.4 on disc 12.1 and being parallel with the 10 minutes indicator line 12.5 on disc 12.1, every 5 minutes, except at the quarter hours, i.e., :15, :30, :45, :60, when the full rectangle 12.9 on disc 12.7 aligns or is parallel with some part of the half rectangle 12.6 on disc 12.1.

Figure 12A:
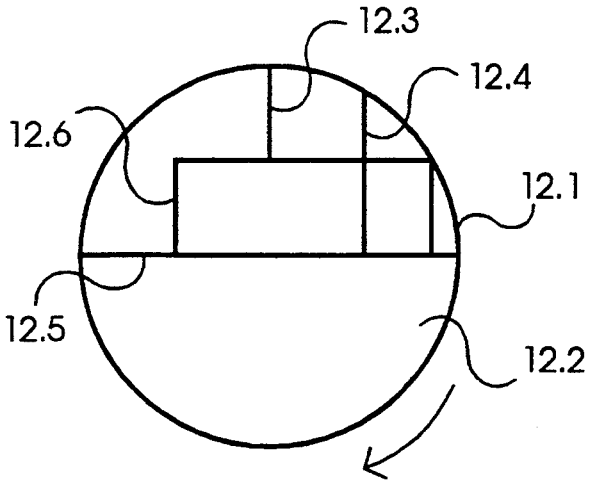
FIGS. 12*a*–12*e* contain frontal, cross sectional and motive views of the twelfth embodiment of the invention.
Figure 12B:
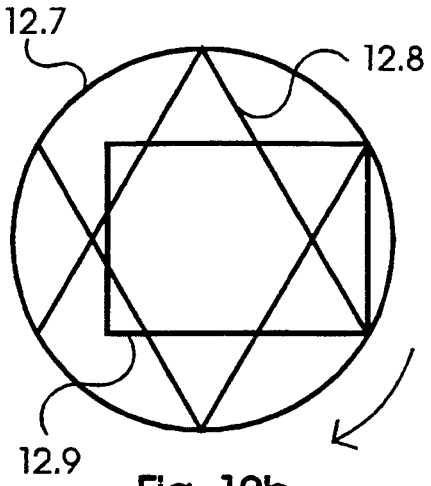
Figure 12C:
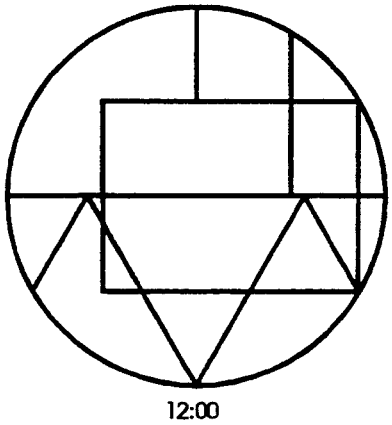
Figure 12D:
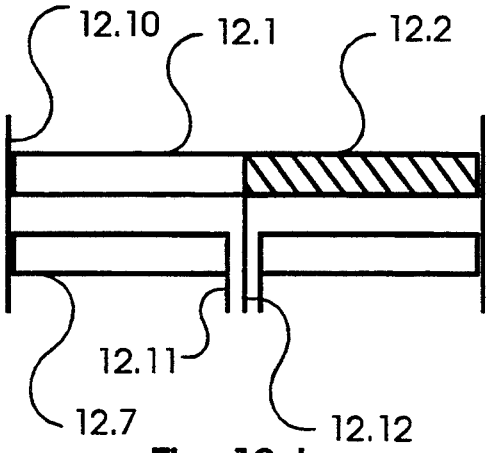
Figure 12E:
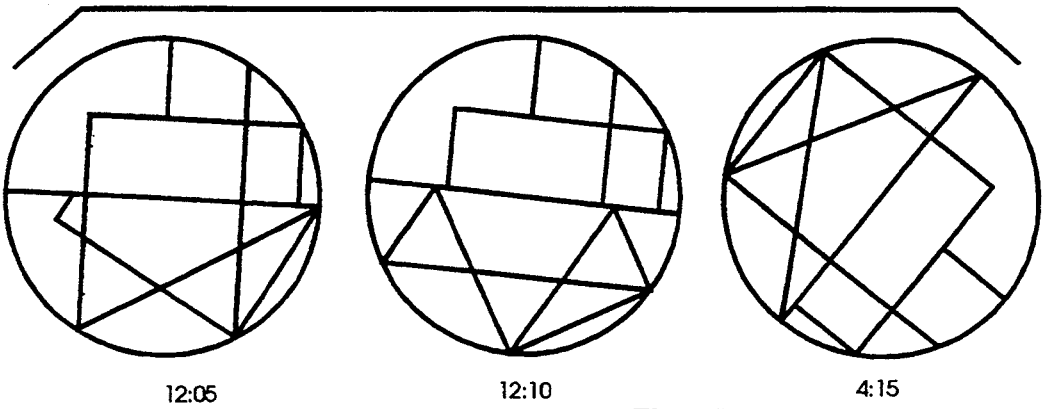

If the hours indicator line 12.3 on disc 12.1 is pointing straight up and the full rectangle 12.9 on disc 12.7 is in perfect alignment with the half rectangle 12.6 on disc 12.1 then the time is 12:00, as illustrated in FIG. 12*c*. As disc 12.1 rotates away from the 12:00 position, disc 12.7 also rotates away so that after 5 minutes the first minutes indicator line on disc 12.7 is aligned with the 5 minutes indicator line 12.4 on disc 12.1 and the time is 12:05, as illustrated in FIG. 12*e*. As the two discs continue to rotate the second minutes indicator line on disc 12.7 will become parallel with the 10 minutes indicator line 12.5 on disc 12.1 at 12:10 (see FIG. 12*e*). Then at 12:15 the full rectangle 12.9 on disc 12.7 will be in alignment or parallel with some part of the half rectangle 12.6 on disc 12.1. This process continues until the full rectangle 12.9 on disc 12.7 is again in perfect alignment with the half rectangle 12.6 on disc 12.1, at which point an hour has past and disc 12.1 is in the 1:00 position, and ready for the same sequence to again pass below its window for the next hour.

To determine the hour, it is necessary to determine where the hours indicator line 12.3 is pointing. Disc 12.1 rotates in the same manner as the hour hand on a normal two hands clock, and therefore with the hours indicator line 12.3 it indicates the hours using the same hourly positions as a normal clock.

To determine the minutes, it is first necessary to determine the position of the full rectangle 12.9 on disc 12.7. Since the linear relationship between the full rectangle 12.9 and the half rectangle 12.6 determine the quarter hour, it is necessary to determine which quarter hour is being displayed and then to determine the position of the linear and parallel relationships between the 5 and 10 minutes indicator lines on disc 12.1, and the indicator lines on disc 12.7. In this manner the indication of minutes is entirely dependant upon the relationship between the two discs wherein one disc continually completes and changes the pattern of the other.

What I claim is:

1. A timepiece characterized by a concentric circular plane or ring within which one or more circular discs or rings each with an external circumference less than 11/12 of the external circumference of the concentric circular plane or ring rotate as time indicators to provide the indication of minutes and the indication of hours such that there exists at least one rotating time indicator disc or ring which synchronizes the indication of minutes and the indication of hours by continually acting as a geometrical link between the two indications without which neither indication would be at all possible, and such that there exists at least one rotating time indicator disc or ring which provides its time indication by treating 60 minutes as representing less than 330° but more than 60° of the 360° circumference of the concentric circular plane or ring at any given moment, and that this portion of the 360° circumference of the concentric circular plane or ring as representing 60 minutes changes its position upon the concentric circular plane or ring from one hour to the next.

2. The timepiece as defined in claim 1, wherein discs or rings indicate time by rotating in eccentric fashion upon and about the internal circumference of a ring.

3. The timepiece as defined in claim 1, wherein designs or drawings are used on the display surfaces of the circular plane or circular discs.

4. A timepiece which presents two optically different concentric discs stacked one upon the other, the upper of which has a window and indicates hours by rotating once in twelve hours, the lower of which has no window and indicates minutes by rotating 13 times in 12 hours, characterized in that the upper hours disc has an incomplete geometrical pattern which is continually completed as the lower minutes disc revolves past its window such that the indication of minutes depends entirely upon the completion of this pattern and in no way upon a 360° circumference as representing any part of its indication.

5. The timepiece as defined in claim 4, wherein there is a degree of accuracy to within 2 minutes.

6. A timepiece which displays the minutes and hours characterized in that it uses an eccentric ring which is made to revolve upon and about a concentric disc, such that the revolution of the eccentric ring upon one entire circumference of the concentric disc is equal to one hour, such that one revolution of the eccentric ring about the fixed space of the concentric disc is equal to more than one hour, such that minutes are determined by the point where the eccentric ring and the concentric disc make contact and a fixed point on the concentric disc, such that hours are determined by the point where the eccentric ring and the concentric disc make contact and a point within a portion less than 360° of the circumference of the eccentric ring representing one hour and whose position upon the eccentric ring changes from one hour to the next.

7. A timepiece which displays the minutes and hours characterized in that it uses two circumferentially different eccentric discs which rotate between the circumferences of two concentric discs and the internal circumferences of two concentric rings such that the equal rotational speeds of the concentric discs cause the eccentric discs to rotate about the concentric rings at unequal rotational speeds relative to each other, such that the position of one eccentric disc on the internal circumferences of the concentric rings is continually gaining distance over the position of the other eccentric disc on the internal circumferences of the concentric rings, wherein hours are determined by the distance between the slower of the two eccentric discs and the faster of tile two eccentric discs, wherein minutes are determined by the distance between the slower of the two eccentric discs and a fixed point upon the concentric discs, as such eccentric disc, and wherein the slower of the two eccentric discs synchronizes the indication of minutes and the indication of hours by continually acting as a geometrical link between the two time indications without which neither indication would be at all possible.

8. The timepiece as defined in claim 1 or claim 6 or claim 7, wherein a single drive pin connects the drive mechanism to the display mechanism and which therefore is used to enact the entire display mechanism.

* * * * *